US012152608B2

(12) United States Patent
Van Rijswick

(10) Patent No.: US 12,152,608 B2
(45) Date of Patent: Nov. 26, 2024

(54) PUMPING SYSTEM

(71) Applicant: Weir Minerals Netherlands B.V., Venlo (NL)

(72) Inventor: Rudolfus Van Rijswick, Venlo (NL)

(73) Assignee: Weir Minerals Netherlands B.V. (NL)

( * ) Notice: Subject to any disclaimer, the term of this patent is extended or adjusted under 35 U.S.C. 154(b) by 667 days.

(21) Appl. No.: 17/259,919

(22) PCT Filed: Jul. 12, 2019

(86) PCT No.: PCT/IB2019/055957
§ 371 (c)(1),
(2) Date: Jan. 12, 2021

(87) PCT Pub. No.: WO2020/016716
PCT Pub. Date: Jan. 23, 2020

(65) Prior Publication Data

US 2021/0293255 A1 Sep. 23, 2021

(30) Foreign Application Priority Data

Jul. 16, 2018 (GB) ..... 1811632

(51) Int. Cl.

| | |
|---|---|
| ***F04B 47/04*** | (2006.01) |
| ***F04F 1/06*** | (2006.01) |
| ***F04F 13/00*** | (2009.01) |
| *E21B 17/01* | (2006.01) |

(Continued)

(52) U.S. Cl.
CPC ..... *F04F 1/06* (2013.01); *F04B 47/04* (2013.01); *F04F 13/00* (2013.01); *E21B 17/01* (2013.01); *E21B 43/29* (2013.01); *E21C 50/00* (2013.01)

(58) Field of Classification Search
CPC .. F04B 47/04; F04F 1/06; E21B 17/01; E21B 43/29; E21C 50/00; B65G 53/30
See application file for complete search history.

(56) References Cited

U.S. PATENT DOCUMENTS

| | | | | |
|---|---|---|---|---|
| 3,371,965 A * | 3/1968 | MacLellan | ..... | E21F 13/042 406/146 |
| 3,449,013 A | 6/1969 | Sakamoto et al. | | |
| 3,873,238 A | 3/1975 | Elfarr | | |

(Continued)

FOREIGN PATENT DOCUMENTS

| | | |
|---|---|---|
| CA | 2770255 A1 | 8/2013 |
| CN | 1561441 A | 1/2005 |

(Continued)

*Primary Examiner* — Connor J Tremarche
(74) *Attorney, Agent, or Firm* — Morriss O'Bryant; Compagni Cannon, PLLC.

(57) ABSTRACT

A pumping system for pumping a medium is described. The system comprises: at least one transverse pressure exchange chamber, but preferably multiple pressure exchange chambers. Each pressure exchange chamber has a valve arrangement at each end. The system also includes a pressurised discharge at a delivery end of the system and a filling mechanism operable to fill the pressure exchange chamber with the medium. A positive displacement pump is operable to pump a driving fluid in direct contact with the medium so that the medium is pumped from the pressure exchange chamber to the pressurised discharge. A method of pumping a medium is also described.

22 Claims, 8 Drawing Sheets

(51) Int. Cl.
*E21B 43/29* (2006.01)
*E21C 50/00* (2006.01)

(56) References Cited

U.S. PATENT DOCUMENTS 3,938,912 A * 2/1976 Sakamoto ..... B65G 53/30 417/900
4,114,954 A * 9/1978 Pasieka ..... B65G 53/30 406/93
4,230,299 A * 10/1980 Pierce, Jr. ..... F16K 43/008 251/282
4,231,686 A 11/1980 Sakamoto et al.
4,294,284 A * 10/1981 Herd ..... F16K 3/0254 251/327
4,387,595 A 6/1983 Sakamoto et al.
4,563,112 A * 1/1986 Mokuya ..... B65G 53/30 406/106
4,586,852 A * 5/1986 Oda ..... B65G 53/30 406/137
5,052,486 A * 10/1991 Wilson ..... B01F 23/45 166/308.4
5,775,803 A * 7/1998 Montgomery ..... B01F 35/8311 366/152.2
2016/0222985 A1 8/2016 Oklejas

FOREIGN PATENT DOCUMENTS

CN 105966922 A 9/2016
CN 106948820 A 7/2017
GB 1505066 A 3/1978
JP 56113616 A 9/1981
JP 2016205074 A 12/2016
TW 500822 B 9/2002
WO 199311361 A1 6/1993
WO 2010130002 A1 11/2010
WO 2018084831 A1 5/2018
WO 2018085742 A1 5/2018

* cited by examiner

310

PUMPING SYSTEM

TECHNICAL FIELD

The present invention relates to a pumping system. In particular, although not exclusively, the present invention relates to a pumping system for use in the minerals processing industry.

BACKGROUND

In the minerals processing industry, one problem relates to transporting ore from underground or subsea locations to a surface level. In most such applications this transportation includes raising the ore vertically as well as transporting it horizontally.

For relatively small vertical distances, belt or truck transport arrangements are the dominant transport methods. For underground mines the most dominant transport method is skip hoisting in which a skip is hoisted to the surface after being loaded with ore underground. In sea bed mining, which is a relatively new application, multiple methods are being considered, such as skip hoisting, air lift, or hydraulic hoisting. In hydraulic hoisting the ore is mixed with a carrier fluid, for example water, to form a suspension of ore particles which can then be pumped to the surface. The mixture of solid particles and the carrier fluid is referred to as a slurry.

In sea bed mining hydraulic hoisting is considered most suitable as the ore is typically mined using water based excavation methods delivering a suspension of ore in water as the so-called Run-Off-Mine (ROM) ore. There are a number of advantages in applying hydraulic hoisting to underground and sea bed mines. These advantages include the following.

Construction of a riser pipe for hydraulic hoisting from an underground mine is much more cost effective than construction of a skip hoist system as a bore for a riser can be drilled and has a much smaller cross-section than a shaft required for a skip hoist.

Construction of a riser pipe and the required surface infrastructure for hydraulic hoisting is much less invasive than required for skip hoisting.

Riser pipes for hydraulic hoisting do not have to be completely vertical, which allows more freedom in the location of the surfacing point with respect to the underground starting point.

These last two advantages are particularly advantageous for mines in densely populated regions or with difficult surface terrain conditions.

Hydraulic hoisting is a continuous process compared to the batch process for skip hoisting which allows for more process automation with less operator dependence and interference.

With skip hoisting the capacity of a specific cross section shaft scales inversely with the depth as the travel time of the skips determines the number of batches one can hoist per unit of time. With hydraulic hoisting the capacity is defined by the flow velocity and pipe diameter, which capacity is not impacted by the depth.

During the excavation process the ore is broken down into smaller particles such that the ore can be handled as a granular material. However, the size reduction before the hoisting step is preferably limited to reduce the requirement for installation of expensive, high energy consumption comminution (particle size reduction) equipment near the excavation location, which may be at the sea bed, or down an underground mine.

Particle sizes of ROM ore which have not had much additional size reduction are in the range from 1 to 100 mm. When mixed with water this gives a so-called settling slurry in which the particles will settle out quickly when the mixture is stagnant. A slurry is a two phase mixture (a liquid with solid particles suspended or otherwise located therein). This is different to mixtures typically seen in mineral processing applications. In mixtures with fine particles (less than 50 μm diameter), the particles only settle out slowly such that settling does not present any problems with transportation of the slurry.

In hydraulic ore hoisting the relatively large particles in the range of 1 to 100 mm must be suspended in a carrier fluid while being transported to the surface via a riser pipe. Hoisting depths are typically in the range of 100 to 2000 m for underground mining and 5000 m for sea bed mining. The main challenges for a hydraulic ore hoisting system in such an environment would be the relatively large particle size to be transported in combination with the high pumping pressure required for the typical hoisting depths.

The relatively large particle size places constraints on the pumping equipment which can be used in a hydraulic ore hoisting system. Large passage slurry centrifugal pumps that can handle the typical particle size are available, but are limited in their head rise, which is typically less than 50 m. This would require an extensive number of such pumps to be placed in series to overcome the pressure requirements in a hydraulic ore hosting system. With increasing numbers of centrifugal pumps in series the complexity of the system increases, and the reliability of the system decreases. Furthermore, the energetic efficiency of the large passage slurry centrifugal pumps is limited compared to multi-stage clean liquid centrifugal pumps or positive displacement pumps, typical 70% versus respectively 80% and 90%. The use of multiple large passage slurry centrifugal pumps in hydraulic ore hoisting systems is therefore limited because of these disadvantages.

Prior art high efficiency multi-stage clean liquid centrifugal pumps are obviously not suitable as the internal passage areas are typically too small and the internal velocities are too high resulting in excessively high wear rates when handling solids-laden fluids or slurries. Prior art positive displacement pumps capable of handling abrasive slurries do exist but have limitations when handling particles larger than 1 mm. These limitations are mainly related to the operation of the pump chamber isolation valves which do not properly close and seal in the presence of larger particles. Furthermore, the flow velocities in the prior art positive displacement pumps are typically too low to reliably suspend the larger particles resulting in blockage when handling significant quantities of these larger particles.

To overcome some of these issues several pressure exchange concepts have been proposed in the past. In a pressure exchange system, a pressure exchange chamber is first filled with the fluid to be pumped (referred to as the pumped fluid) via a valve arrangement by a low-pressure filling system. Upon filling the pumped fluid displaces the fluid already in the pressure exchange chamber (referred to as the driving fluid) out of the chamber by another valve arrangement. Once the chamber is filled with the pumped fluid, the pumped fluid inlet and driving fluid outlet valves are closed. Sequentially a high-pressure driving fluid inlet valve and a high-pressure pumped fluid outlet valve is opened allowing high-pressure driving fluid to enter the pressure exchange chamber and thereby displacing the pumped fluid out of the chamber via the pumped fluid outlet valve into the high pressure discharge connection.

All prior art pressure exchange systems however rely on a clean liquid pump to supply the high-pressure driving fluid to the system. Most of the prior art pressure exchange systems use high efficiency multi-stage clean liquid centrifugal pumps for this purpose. The fluid coming out of the pressure exchange chamber upon filling the chamber with pumped fluid is typically re-used as driving fluid to minimise any wastage of the driving fluid. Most prior art pressure exchange systems therefor use a separating element in the pressure exchange chamber separating the pumped fluid and the driving fluid. The function of this separating element is to prevent mixing of the driving fluid and the pumped fluid while exchanging pressure between them. Prior art pressure exchange systems use separating elements in different forms and shapes, including: floats in a vertically arranged pressure exchange chambers, floating pistons in horizontally arranged pressure exchange chambers, and hermetically sealed flexible separating elements in various shapes and forms, for example cylindrical diaphragms or membranes and bladder-shaped or hose-shaped geometries.

The floating separating elements however do not provide a hermetic seal between the pumped fluid and driving fluid resulting in mixing of both fluids. In a pressure exchange system handling abrasive slurries this results in contamination of the driving fluid expelled from the pressure exchange chamber during filling of the chamber with pumped fluid. This contamination would need to be removed from the driving fluid before being re-used to prevent excessive wear rates in the high-pressure driving fluid pumps. Full decontamination of the driving fluid is not practical or possible, which then results in a compromised reliability of the high-pressure driving fluid pumps due to contamination in the driving fluid.

Some prior art pressure exchange systems attempt to limit the mixing over the floating separating element by using a vertically arranged pressure exchange chamber allowing the particles to settle away from the separating element. Although this might work for an intermediate particle size range of 100 to 500 μm, smaller particles do no settle away from the separating element quickly enough and are furthermore kept in suspension by the turbulent flow in the pressure exchange chamber. Particles larger than approximately 500 μm settle away from the separating element but will settle too quickly and will form a sediment on the bottom of the pressure exchange chamber. If the quantity or total volume of the larger particles is too high, it will form a blockage at the bottom of the pressure exchange chamber obstructing discharge of the pumped fluid into the high-pressure discharge connection.

Furthermore, velocities of the floating separating element have to be limited to ensure its durability. This places constraints on the fluid velocities in the pressure exchange chambers further limiting their successful application for large particle settling mixtures as are present in hydraulic ore hoisting applications, independent on the vertical or horizontal arrangement of the pressure exchange chamber. This is because relatively high flow rates are required to prevent settling of the particles in the slurry.

Prior art pressure exchange systems using hermitically sealing separating elements prevent the mixing of the pumped fluid and driving fluid. The hermitically sealing separating elements however place geometric constraints on the size and aspect ratio of the pressure exchange chamber. The limitation in size results in relatively small volumes to be displaced per cycle. In combination with the minimum flow velocity requirements in the pressure exchange chamber to suspend the particles to be transported, this would result in relatively short cycle times. The short cycle times results in a large number of valve actuations resulting in high wear rates in the valve when operating in the presence of larger particles. The short cycle times further limit periods of idle flow around the valves which otherwise could be used to allow larger particles to settle away from the functional sealing surfaces in the valve. Prior art hermetically sealed pressure exchange systems typically use a vertical or at least inclined arrangement of the pressure exchange chamber with the pumped fluid in and outlet valves on the bottom end, and the driving fluid in and outlet valves on the top end thereby using the settlement of the larger particles to assist in emptying the pressure exchange chamber during the discharge phase of the cycle. However, the vertical arrangement results in sedimentation of the larger particles at the bottom of the pressure exchange chamber, obstructing the discharge of the chamber when sediment quantities are too high. This limits solids concentration which can be handled by such a pressure exchange system and requires relatively short fill and discharge phases in the range of 2 to 5 seconds when handling settling mixtures with larger particles.

All prior art pressure exchange systems using a separating element need to stop filling, or discharging, of the pressure exchange chamber when the separating element has reached the end of its allowable travel. Operation beyond these limits will either damage the separating element or result in a hard stop of the flow in or out of the pressure exchange chamber. This poses additional constraints in the system operation, especially when using multiple chambers in parallel which are to be filled and discharged sequentially. First, the end of travel needs to be detected which typically requires some detection device which may not be trivial. The time of the fill and discharge phase is fixed when using fixed filling discharge flow rates and doesn't allow for extension of, for example, a discharge phase of one chamber when the next chamber in the sequence is not yet ready. As the separating element must stay within the pressure exchange chamber some pumped fluid will remain in the pressure exchange chamber at the end of the discharge phase. Specifically when transporting larger particle slurries, this requires additional measures to prevent a gradual build-up of lager particles within the pressure exchange chamber. Most prior art pressure exchange systems anticipated for handling larger particle slurries would attempt to do this using a vertical or at least a steeply inclined arrangement of the pressure exchange chamber.

Some proposed prior art open pressure exchange systems may use a pressure exchange chamber in the form of an elongate pipe, but rely on a clean fluid supply to the high pressure driving fluid pump as they use a high efficiency clean fluid multi-stage centrifugal pump. This limits the direct re-use of driving fluid expelled from the pressure exchange chamber during the filling phase due to its contamination by the mixing of medium and driving fluid.

Re-use of the carrier fluid (the liquid part of the pumped medium) after separating the solids at the end of the transport or hoisting system is limited as the carrier fluid is contaminated with smaller particles as well. In both cases extensive solids separation is required to enable reliable operation of the driving fluid pumps which are not designed to handle contaminated fluids.

Furthermore, prior art open pressure exchange systems typically use knife gate valves for the fluid in and outlet valves. These valves open when actuated, independently of the pressure differential across the valves. This can cause high flow velocities when opened in pressure unbalanced situations resulting in high wear rates when handling abrasive slurries.

The use of centrifugal driving fluid pumps further complicates the flow assurance in the pressure exchange chamber and the transport line or riser to the surface in hydraulic ore hoisting systems. A centrifugal pump delivers a flow rate which is dependent on the pressure it has to deliver which is furthermore impacted by the wear state of the impeller of the pump. In a hydraulic ore hoisting system it is very important to guarantee that the transport velocities in the system are above the critical deposition velocities to prevent a solids build-up in the system which can lead to a blockage of the system. Some control of flow rate by speed control of centrifugal driving fluid pumps is possible but this is limited as the centrifugal pumps have a relatively narrow flow range in which they operate reliably with high efficiency.

It is among the objects of an embodiment of the present invention to obviate or mitigate the above disadvantages or other disadvantages of the prior art.

The various aspects detailed hereinafter are independent of each other, except where stated otherwise. Any claim corresponding to one aspect should not be construed as incorporating any element or feature of the other aspects unless explicitly stated in that claim.

Reference in this specification to any prior publication (or information derived from the prior publication), or to any matter which is known, is not, and should not be taken as an acknowledgment or admission or any form of suggestion that the prior publication (or information derived from the prior publication) or known matter forms part of the common general knowledge in the field of endeavour to which this specification relates, or is even citable as prior art against this application.

SUMMARY OF DISCLOSURE

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

According to a first aspect, there is provided a pumping system for pumping a medium, the system comprising: (i) at least one pressure exchange chamber comprising a transverse elongate pipe having a valve arrangement at each end; (ii) a pressurised discharge at a delivery end of the system; (iii) a filling mechanism operable to fill the pressure exchange chamber with the medium; and (iv) a positive displacement pump operable to pump a driving fluid in direct contact with the medium so that the medium is displaced from the pressure exchange chamber to the pressurised discharge by the driving fluid.

The medium may comprise a single phase or multi-phase mixture. An example of a single phase mixture is water; an example of a two-phase mixture is a liquid with ore particles (also referred to as a slurry) or a paste (which is a mixture formed from a highly concentrated suspension of very small particles). The ore particles may vary in size from below 1 mm to approximately 100 mm. The slurry may comprise settling particles in a carrier fluid which mixture is referred to as a settling slurry.

The pressure exchange chamber (sometimes referred to as the pump chamber) comprises a transverse elongate pipe. The pipe may be relatively long, for example, 100 m in length, in some embodiments, the pipe may be at least 10 m in length. The pipe may extend in a transverse orientation (closer to a horizontal orientation than a vertical orientation). The transverse orientation may be a generally flat (horizontal or generally horizontal) orientation or an orientation at a relatively shallow incline, in a straight, curved, or helical manner. The pipe may extend in a generally level orientation (notwithstanding localised deviations therefrom) along a sea bed, ground, or other surface. The pipe length may be determined or influenced by the flow velocity (of the medium filling the pipe) and the required fill and discharge time; for example 4 $ms^{-1}$ flow velocity for a 25 s fill time would require a pipe length of 100 m. In some embodiments, the pipe length may be selected from the range of 20 m to 400 m.

The driving fluid may comprise a single phase fluid, such as water (sea water, desalinated water, untreated water, or the like).

A first valve arrangement is preferably located at one end of the pressure exchange chamber and comprises a driving fluid entry valve, a driving fluid exit valve, a compression valve, and a decompression valve. These valves are preferably suitable for use with high pressures (e.g. greater than 40 Bar). These valves may comprise actuated valves.

To allow the driving fluid entry and exit valves to open in a generally pressure balanced environment, a pressure balancing line may be provided. This pressure balancing line may include the compression or decompression valve for the pressure exchange chamber in a bypass arrangement (i.e. bypassing the driving fluid entry and exit valves).

The compression valve is provided to bypass the driving fluid entry valve so that the pressure in the pressure exchange chamber can be raised prior to opening of the driving fluid entry valve; thereby reducing the force required to open the valve and reducing the fluid flow rate through the driving fluid entry valve upon opening. This has the advantage of prolonging the life of the driving fluid entry valve.

Similarly, the decompression valve is provided to bypass the driving fluid exit valve so that the pressure in the pressure exchange chamber can be lowered prior to opening of the driving fluid exit valve; thereby easing discharge of the driving fluid through the driving fluid exit valve upon opening thereof.

The compression and decompression valves are preferably designed to open against a high pressure differential. However, these valves primarily allow flow of the driving fluid (not the medium being pumped) and therefore operate on cleaner fluid (having fewer particles, or at least fewer large sized particles).

By using a positive displacement pump, the pumping system has the advantage of not requiring a complicated control arrangement to ensure that the flow rate is sufficient to prevent settling due to gravitation forces. This is because a positive displacement pump creates a fixed flow rate that is independent of pressure. By using a positive displacement pump to drive the medium out of the transverse pressure exchange chamber, opening and closing of the valves to allow entry and exit of the driving fluid can be controlled by time, rather than requiring elaborate sensors.

By using a positive displacement pump, the driving fluid does not need to be clean water but can contain smaller particles, for example particles smaller than 500 μm.

Using a pressure exchange system has the advantage that the filling mechanism can pre-fill the pressure exchange chamber with the medium to be pumped to the pressurised discharge (without requiring a high pressure pump); thereafter, the positive displacement pump can displace the medium to the pressurised discharge at high pressure.

A second valve arrangement is preferably located at an end of the pressure exchange chamber near to the pressurised discharge and comprises a pumped fluid (or medium) exit valve (also referred to as a discharge valve) and a pumped fluid (or medium) entry valve (also referred to as a suction valve). The pumped fluid entry and pumped fluid exit valves open in a pressure balanced situation when the pressure exchange chamber is properly decompressed or compressed respectively. These valves may comprise actuated valves.

The pumped fluid exit and entry valves are preferably suitable for use with high pressures (e.g. greater than approximately 40 Bar).

The driving fluid entry valve may be opened at the same time (or approximately the same time) as the pumped fluid exit valve, during which time the driving fluid exit valve and the pumped fluid entry valve remain closed.

Similarly, the pumped fluid entry valve may be opened at the same time (or approximately the same time) as the driving fluid exit valve, during which time the pumped fluid exit valve and the driving fluid entry valve remain closed.

In preferred embodiments, closing the pumped fluid entry and exit valves is delayed with respect to the driving fluid entry and exit valves; in other words, the driving fluid entry and exit valves are closed before the pumped fluid entry and exit valves. This has the advantage of stopping the flow of driving fluid (and hence also the flow of the medium) before the pumped fluid entry and exit valves are closed. This allows the larger particles in the medium to settle away from the pumped fluid entry and exit valves, before closing the pumped fluid entry and exit valves; thereby lowering the risk of trapping large particles of the medium in the valve (which may otherwise damage the valve and prohibit it from closing and thereby prohibiting continuation of the operating sequence).

In preferred embodiments, the driving fluid entry and exit valves may comprise actuated valves, such as actuated, non-return, poppet seated valves, so that the geometry of the valve assists in valve opening and closing. The pressure differential at which poppet valves open is typically small compared to the pressure load they can take when blocking the flow in the reverse direction.

Pumped fluid entry and exit valves may comprise self-acting valves, but in preferred embodiments these comprise actuated valves, such as actuated, non-return, poppet seated valves.

Actuated valves typically allow a larger valve opening compared to self-acting valves. Larger valve opening allows passage of larger particles compared with self-acting valves. Furthermore, actuated valves allow greater flexibility with respect to timing, this for example allows a delayed closure of the pumped fluid entry and exit valves relative to respectively the driving fluid exit and entry valves.

The advantage of the valves only opening when there is a small pressure differential across the valve is that the valves open automatically once the pressures on both sides are approximately equal. If a valve was opened with a large pressure differential, fluid would flow through the valve at high velocity when the valve starts to open in an attempt to balance the pressures on both sides of the valve. Where the fluid passing through the valve is a slurry, the high velocity flow contains solid particles that will quickly erode the valve body and seat.

In some embodiments, the poppet valves are actuated poppet valves. Preferably, the force applied by the actuator is such as to assist valve opening when the pressure differential is low (for example, less than 5 Bar), rather than to force the valve to open even if the pressure differential is high (for example, greater than 40 Bar, or whatever the full pressure differential across the pump is).

Preferably, the poppet valves are arranged such that the pressure differential across the valves when closed assists in retaining the valves in the closed position. For the pumped fluid entry and pumped fluid exit valves, the flow direction of the pumped fluid (the medium and the driving fluid) assists in opening those valves. For the driving fluid entry and exit valves, the flow direction of the pumped fluid (the medium and the driving fluid) works in the opposite way, assisting the valve to close.

In some embodiments, the compression and decompression valves comprise actuated ball valves or poppet valves, or any other type of valve that can be actuated in the presence of a high-pressure differential across the valve. The bypass lines in which the compression and decompression valves are located can further have a choke installed in series with the compression and decompression valves to limit and control the flow rate during compression and decompression.

The first and second valve arrangements may comprise actuated, poppet, non-return valves that are oriented and configured so that a pressure differential across each valve acts on a high pressure side of the valve to assist in maintaining the valve in a closed position when the valves are not actuated. This has the advantage that no additional (external) force is required to maintain the valves in a closed position.

The first valve arrangement may comprise actuated, poppet, non-return valves that are oriented and configured so that the flow direction of the driving fluid assists in closing these valves.

The second valve arrangement may comprise actuated, poppet, non-return valves that are oriented and configured so that the flow direction of the pumped medium assists in opening these valves.

The actuator force may be selected so that the valves only open in the presence of a small pressure differential (e.g. <10 Bar) even when actuated. This avoids the requirement for accurate timing of opening the valves as the valve can be actuated prior to the pressure differential being low enough as the valve will automatically open when the correct pressure differential is reached. This has the advantage that excess wear due to a high flow velocity, caused by a high pressure differential, is avoided.

In some applications, e.g. deep-sea mining, the driving fluid exit valve may discharge the driving fluid to the surrounding water. In other applications, e.g. underground mining, the driving fluid exit valve may discharge the driving fluid into a reservoir or into a feed for another pumping fluid pump, such as a second positive displacement pump.

The driving fluid entry valve has to seal the high-pressure driving fluid supply line to the low pressure in the pressure exchange chamber when the pressure exchange chamber is being filled with medium. The driving fluid exit valve has to seal the high-pressure pressure exchange chamber to low pressure driving fluid outlet line when the medium is being discharged from the pressure exchange chamber. The pumped fluid entry (suction) valve has to seal the high-pressure pressure exchange chamber to the low-pressure medium supply or suction line when the medium is being discharged from the pressure exchange chamber. The pumped fluid exit (discharge) valve has to seal the high-pressure medium discharge line to the low pressure in the pressure exchange chamber when the pressure exchange chamber is being filled with medium.

Preferably, the positive displacement pump pumps the driving fluid in the same direction as (rather than in a transverse direction to) the direction in which the medium is flowing when displaced to the delivery end. Advantageously, where the pressure exchange chamber is a pipe, the driving fluid and the medium are both pumped longitudinally with respect to the pressure exchange chamber.

The filling mechanism may comprise a centrifugal pump, which has the advantages that it can directly handle large particles and can have a relatively high flow rate. Alternatively, the filling mechanism may comprise a gravity fed system, which has the advantage of avoiding the need for an additional pump. Other options include a screw pump, or any other convenient pump or feed mechanism.

The pressurised discharge may comprise a feed to a riser, where the riser extends from the pressurised discharge to a surface level. The surface level may be more than 100 m above the pressurised discharge. Alternatively, the pressurised discharge may comprise a feed to a pressurised container or a feed into a horizontal transportation line of some larger length requiring a high pressure.

In some embodiments, a plurality of pressure exchange chambers are connected in parallel.

If only one pressure exchange chamber is used, then there may be problems due to pulsation of the medium being pumped. Furthermore, with one pressure exchange chamber, the filling phase and the discharge phase cannot be continuous.

The advantage of using two pressure exchange chambers in parallel is that one of the pressure exchange chambers can be filled (or be in the process of being filled) with the medium while the other pressure exchange chamber is being discharged using the driving fluid. Uninterrupted discharge is possible, but the filling phase must be accelerated with respect to the discharge phase to have it prepared to take over once the other chamber has finished its discharge phase.

The advantage of using three pressure exchange chambers in parallel is that at least one pressure exchange chamber can be completely filled with medium and ready for discharge while another pressure exchange chamber is being discharged. For example, one of the pressure exchange chambers can be completely filled, waiting for discharge; another pressure exchange chamber can be subject to the filling process but not yet completely filled (i.e. the filling process is ongoing for that pressure exchange chamber); and the third pressure exchange chamber can be subject to the discharge process (i.e. the discharge process is ongoing for the third pressure exchange chamber).

This allows uninterrupted filling and discharge, with a margin of safety in the timing of the individual phases.

More than three pressure exchange chambers may be used if redundancy is desired, for example, in deep sea installations where access to the pressure exchange chambers for maintenance or replacement may be difficult or expensive.

Where a plurality of pressure exchange chambers are provided, a system controller (or an enhanced valve actuator) may be provided to actuate the compression and decompression valves and the entry and exit valves at the appropriate times to ensure that one pressure exchange chamber is full of medium while another pressure exchange chamber is being filled with medium.

The positive displacement pump may be located at approximately the same altitude (or depth) as the pressure exchange chamber or chambers. This has the advantage that the positive displacement pump is located near to the pressure exchange chambers thereby improving load response time when switching between pressure exchange chambers.

Where the pressure exchange chambers are located underground (as opposed to on a sea bed) this has the disadvantage that the positive displacement pump has to deliver the full power to overcome the pressurised discharge (i.e. to lift the medium to the surface). The pressure required is the sum of the hydrostatic pressure of the mixture in a riser (from the pressurised discharge to the surface) and the frictional pressure losses in the riser. Furthermore, energy consumption is high because the positive displacement pump has to overcome high pressure to raise the medium to the surface. Where the pressure exchange chambers are located on a sea bed, the surrounding water can be used as the driving fluid, and this has hydrostatic pressure based on the depth of the water, so the positive displacement pump only has to overcome the pressure difference due to the density difference of the sea water and the medium in the riser, plus the frictional losses in the riser.

In addition, it may be expensive to provide a high energy power source where the pressure exchange chambers are located (e.g. down a mine or on a sea bed).

Alternatively, the positive displacement pump may be located at significantly higher altitude than the pressure exchange chamber or chambers (e.g. at surface level on a mine, or on a floating platform or boat on the water surface). By locating the positive displacement pump at the surface, the high energy power source can be installed at the surface. The pressure rating of the positive displacement pump casing can be significantly lower as the maximum pressure to be created by the positive displacement pump is much lower since the driving fluid has the benefit of the hydrostatic pressure when pumped down to the pressure exchange chamber. The energy consumption is much lower when using the hydrostatic pressure in the driving fluid supply line in the case of underground mining.

The positive displacement pump requires a source of fluid to use as the driving fluid. The source of driving fluid can be an external source or it can be provided from the driving fluid being expelled from the driving fluid exit valve or it can be provided from the discharge of the pumping system by re-using the carrier fluid after the larger particles have been removed from the pumped medium or a combination of them. This fluid must either be recovered (for reuse), replaced, or a combination of the two. In some embodiments, used driving fluid may not be reused as driving fluid, but may be reused as carrier fluid for the medium to be pumped.

The driving fluid may be provided from the surface or from the same altitude as the pressure exchange chamber or chambers. As used herein, a positive altitude refers to a height above a surface level (which may be sea level) and a negative altitude refers to a depth below the surface, so altitude may refer to either height above, or depth below, the surface; and the surface may be below, at, or above sea level.

In embodiments where the driving fluid is provided from the surface, a driving fluid riser may be used to provide fluid communication between the surface and the pressure exchange chamber. Where the medium contains water or other fluid, then this can be recovered (by removing the ore or other large particles) from a medium riser (extending from the pressurised discharge to the surface) and reused by flowing it into the driving fluid riser (or the positive displacement pump if the positive displacement pump is also located at the surface).

By providing driving fluid at the surface, the pumping system benefits from the hydrostatic pressure, thereby reducing the energy requirements of the positive displacement driving fluid pump.

In underground applications, it may be beneficial to reuse the driving fluid expelled when the medium is filling the pressure exchange chamber; otherwise, this fluid may need to be pumped to the surface as part of the mine dewatering operation. If an additional (smaller) pump is located at the pressure exchange chamber level, then the expelled driving fluid can be used to supplement the driving fluid being provided from the surface by being pumped in parallel with the driving fluid from the positive displacement pump. The larger remainder of the expelled driving fluid can be used to generate medium to be pumped (i.e. it can be used as the carrier fluid in which ore particles are located). This additional (smaller) pump could be used in underground applications, and may be provided in a closed loop configuration so that no external fluid source is required for the driving fluid or the fluid used to create the medium to be pumped.

In embodiments where the driving fluid is provided from the same altitude as the pressure exchange chamber, a separate driving fluid riser may not be required. However, fluid for creating the medium and fluid for creating the driving fluid needs to be available. In sea bed applications there is sea water available for both uses. In underground mining applications, this fluid may be supplied from the surface (but not necessarily via a riser) or may be available as mine water which otherwise needs to be lifted to the surface by the mine dewatering system. In such applications, the requirement for driving fluid and medium fluid may obviate or reduce the need for any separate mine dewatering equipment.

Any medium that is pumped out of the pressure exchange chamber at the driving fluid end can be recycled for future use.

A plurality of positive displacement pumps may be provided in parallel to pump a driving fluid in direct contact with the medium. The positive displacement pumps may all be provided at the same altitude, or they may be provided at different altitudes; for example, one or more positive displacement pumps may be located at a surface, and one or more positive displacement pumps may be located at the pressure exchange chamber altitude.

It will now be appreciated that the positive displacement pump may be located at the surface or at a negative altitude. Similarly, the driving fluid may be provided from the surface or from the negative altitude, or a combination of the two.

By using a positive displacement pump to pump a driving fluid in direct contact with the medium there is no mechanical separation (no float or diaphragm) between the driving fluid and the medium. The absence of a mechanical separator allows the driving fluid to be driven beyond the pressure exchange chamber if required, and ensures that there is no end of stroke position that must be adhered to.

By having multiple pressure exchange chambers, a pressure exchange chamber can be filled with medium by a low-pressure pump (such as a centrifugal pump), the medium can be allowed to settle so that large particles rest on a floor of the pressure exchange chamber, the valves can then be closed with reduced risk of being jammed or damaged by a large particle because of the particle settlement. The pressure exchange chamber can then be pressurised and emptied by pumping driving fluid therein. The driving fluid can be pumped beyond the exit valve to reduce the possibility of the valve closing on any particle from the medium.

According to a second aspect, there is provided a method of pumping a medium, the method comprising: (i) depressurising a pressure exchange chamber; (ii) filling the pressure exchange chamber with a medium to be pumped using a relatively low pressure source; (iii) pressurising the pressure exchange chamber using a positive displacement pump; and (iv) driving out the medium using a driving fluid in direct contact with the medium, where the driving fluid is delivered using the positive displacement pump.

Step (ii) may further comprise filling a pressure exchange chamber such that the medium passes through the pressure exchange chamber (or a substantial part of the pressure exchange chamber) and out via a driving fluid exit valve.

Step (iv) may further comprise driving out the medium using a driving fluid in direct contact with the medium such that the driving fluid passes through the pressure exchange chamber (or a substantial part of the pressure exchange chamber) and out via a pumped fluid exit valve.

The method may comprise performing steps (i) to (iii) on a first pressure exchange chamber, and performing at least some of steps (i) to (iii) on a second pressure exchange chamber before or while step (iv) is performed on the first pressure exchange chamber.

According to a third aspect there is provided a pumping system for pumping a medium to a raised level, the system comprising: at least one non-vertical pipe, each pipe having a valve arrangement at each end; a filling system operable to fill the non-vertical pipe; a riser extending from the non-vertical pipe to the raised level and for delivering the medium thereto; characterised by a positive displacement pump operable to pump a driving fluid in direct contact with the medium being raised to the raised level so that the medium is pumped from the pipe through the riser to the raised level.

The pumping system may further comprise a controller for controlling the operation of the system, including opening and closing of valves in each non-vertical pipe.

The non-vertical pipes may each be included in a pressure exchange chamber.

According to a fourth aspect there is provided a pumping system for pumping a medium to a raised level, the system comprising: a plurality of non-vertical pipes, each pipe having a valve arrangement at each end; a filling system operable to fill the non-vertical pipes in sequence; a riser extending from the non-vertical pipes to the raised level and for delivering the medium thereto; a positive displacement pump operable to pump a driving fluid in direct contact with the medium being raised to the raised level so that the medium is pumped from each of the pipes in turn through the riser to the raised level; wherein the flow rate of the filling system is such that at least one of the pipes is filled with medium prior to the positive displacement pump being applied to that pipe thereby ensuring a constant flow of medium from the pipes to the raised level.

According to a fifth aspect there is provided a floating platform for use with a pressure exchange system, the floating platform comprising: (i) a positive displacement pump mounted on the platform for coupling to a riser extending downwards to a sea bed and coupled to the pressure exchange system, the positive displacement pump being operable to pump a driving fluid in direct contact with a medium in the pressure exchange system so that the medium is displaced from the pressure exchange chamber by the driving fluid; and (ii) a fluid recovery filter mounted on the platform and coupled to a second riser operable to transport medium displaced by the driving fluid to the fluid recovery filter, the fluid recovery filter being operable to remove fluid from the medium and provide it to the positive displacement pump for use as driving fluid.

By virtue of this aspect, unwanted fluid from the medium (tailings) can be returned to the sea bed by using it as driving fluid.

The floating platform may comprise a barge, a ship, a pontoon, or any other floating structure.

It should now be appreciated that one or more of these aspects allow very large particle settling mixtures to be reliably transported in and out of the pressure exchange chamber.

The use of a positive displacement pump for driving fluid has several advantages compared with a multi-stage centrifugal pump as is used in prior art pressure exchange systems.

One advantage is the virtually pressure independent flow rate of a positive displacement pump compared with the highly pressure dependent flow rate of a centrifugal pump. This allows a very stable flow rate in both the pressure exchange chamber (which may comprise a horizontal pipe) as well as in any container (such as a riser) coupled to the pressurised discharge. Pressure load variations on the pump due to re-starting of the settled bed in the pressure exchange chamber, density variations in the riser (or other container) and pressure loss variations in the riser (or other container) have no impact on the flow rate in the riser (or other container). The flow assurance is thereby significantly enhanced resulting in a more reliable hydraulic ore hoisting system.

The second advantage of using a positive displacement pump is that it is much more suitable for handling contaminated driving fluids, compared to multi-stage centrifugal pumps. When using a positive displacement slurry pump the driving fluid itself could even be a high concentration slurry, potentially of higher viscosity such that it can be used as a viscous carrier fluid. This would, for example, allow direct re-use of the contaminated driving fluid coming out of the pressure exchange chamber during the back-fill (filling or suction) stroke in embodiments where the positive displacement pump is installed at the bottom of the hydraulic ore hoisting system. At the surface the ore particles may be separated from the carrier fluid which can then be re-used as driving fluid. Significant contamination of the driving fluid is acceptable when positive displacement pumps are used to pump the driving fluid. This significantly lowers the separation requirements compared to a situation where a multi-stage centrifugal pump would have to pump the recycled carrier fluid as driving fluid.

According to a sixth aspect, there is provided a pumping system for pumping a medium, the system comprising: (i) at least one pressure exchange chamber comprising a transverse elongate pipe having a valve arrangement at each end; (ii) a pressurised discharge at a delivery end of the system; (iii) a filling mechanism operable to fill the pressure exchange chamber with the medium; (iv) a first positive displacement pump located at a first altitude, and (v) a second positive displacement pump located at a second, lower, altitude, the positive displacement pumps co-operating in pumping a driving fluid in direct contact with the medium so that the medium is displaced from the pressure exchange chamber to the pressurised discharge by the driving fluid.

The first positive displacement pump is preferably operable to receive driving fluid from fluid extracted from pumped medium.

The second positive displacement pump is preferably operable to receive driving fluid from fluid in the vicinity of the pressure exchange chamber. This fluid may be extracted from discharged driving fluid or from locally available fluid (sea water, lake water, a pond, an underground water supply, dewatering equipment, or the like).

The pressure exchange system described in the above aspects eliminates or reduces the disadvantages of prior art pressure exchange systems by using a transversely (e.g. horizontally) arranged open pressure exchange system, in which open refers to a direct contact between the medium and driving fluid without using a separating element. An elongate pipe shape of each pressure exchange chamber enables high velocities in the pressure exchange chamber thereby facilitating suspension and transport of particles in the settling slurry.

BRIEF DESCRIPTION OF FIGURES

These and other aspects will be apparent from the following specific description, given by way of example only, with reference to the accompanying drawings, in which.

DETAILED DESCRIPTION

Figure 1:
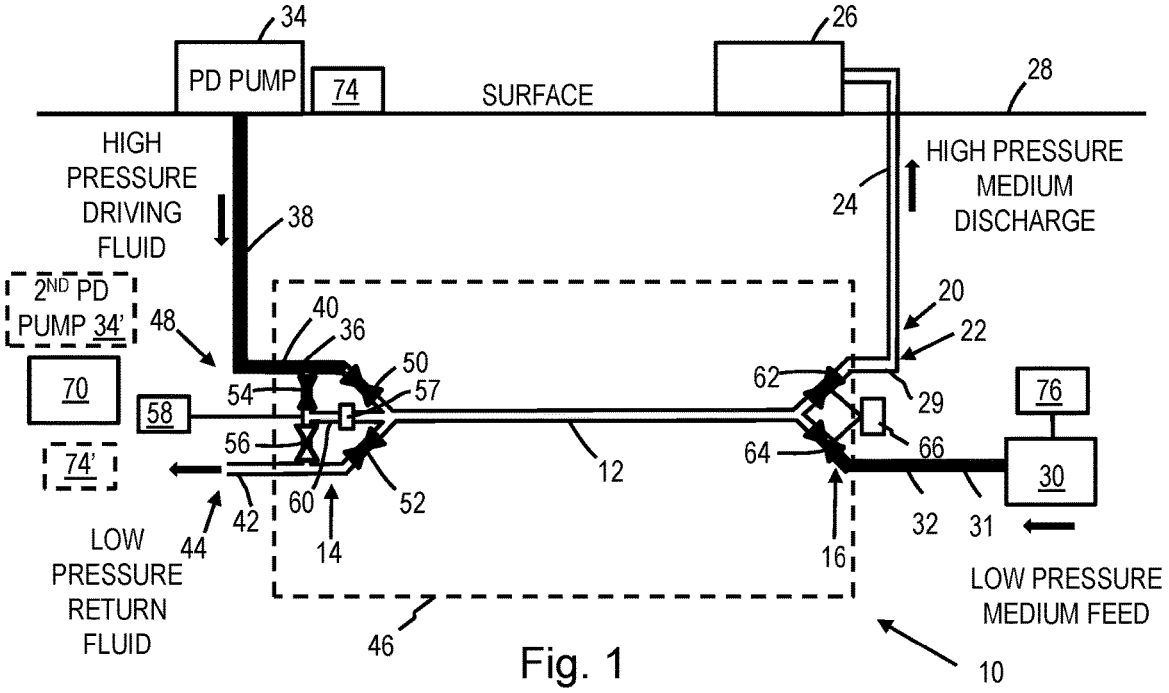
FIG. 1 is a simplified schematic diagram of a pumping system according to a first embodiment of the present invention, where the first embodiment uses only a single pressure exchange chamber, and where the pressure exchange chamber is located beneath a surface to which medium is to be pumped.

Reference is first made to FIG. 1, which is a simplified schematic diagram of a pumping system 10 according to a first embodiment of the present invention. In typical embodiments, most or all of the pumping system 10 is located at a lower altitude than a final delivery point at which a medium is to be delivered by the pumping system 10. In this embodiment, the medium comprises ore particles ranging in size from 1 to 100 mm located in a liquid carrier to produce a slurry of entrained and suspended ore particles.

The pumping system 10 comprises a single pressure exchange chamber 12, which has a valve arrangement 14, 16 at each end thereof, namely a driving fluid valve arrangement 14 and a pumped medium valve arrangement 16.

Figure 1A:
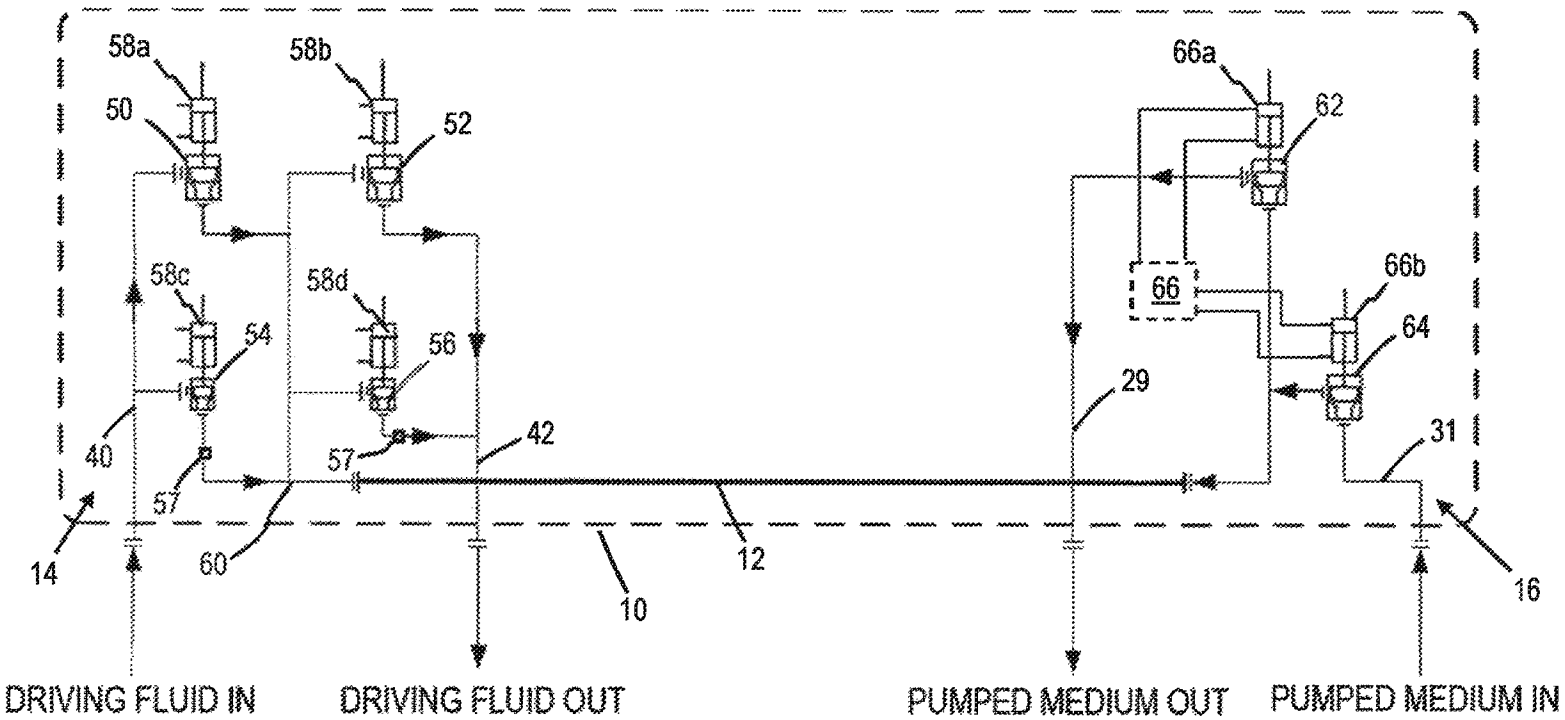
FIG. 1A is a simplified schematic diagram of part of the pumping system of FIG. 1, namely the pressure exchange chamber, to illustrate valve arrangements in the chamber.

Reference is also made to FIG. 1A, which is a simplified schematic diagram of the pressure exchange chamber 12, illustrating the valve arrangements 14,16 in more detail.

A pressurised discharge 20 is provided at a delivery end 22 of the system 10. In this embodiment, the pressurised discharge 20 is an inlet to a pumped medium riser 24 that extends in a generally vertical direction from the delivery end 22 to a collection receptacle 26 at a surface 28. A medium outlet line 29 is coupled between the pumped medium valve arrangement 16 and the pressurised discharge 20.

A filling mechanism 30 is provided, in the form of a centrifugal pump, which is operable to fill the pressure exchange chamber 12 with a medium 32 to be pumped to the surface 28. The centrifugal pump 30 fills the pressure exchange chamber 12 with medium 32 via a medium inlet line 31.

The pumping system 10 also includes a positive displacement pump 34 operable to pump a driving fluid 36 through the pressure exchange chamber 12 and in direct contact with the medium 32 so that the medium 32 is displaced from the pressure exchange chamber 12 to the pressurised discharge 20 and from there to the surface 28 via the pumped medium riser 24.

The positive displacement pump 34 is coupled to the driving fluid valve arrangement 14 via a driving fluid riser 38 and a driving fluid inlet line 40.

A driving fluid outlet line 42 connects the pressure exchange chamber 12 to a driving fluid discharge point 44.

The combination of the pressure exchange chamber 12, the driving fluid valve arrangement 14, the pumped medium valve arrangement 16, the driving fluid inlet and outlet lines 40,42, and the medium inlet and outlet lines 31,29 is referred to herein as an open pressure exchange system 46. "Open" refers to the direct contact between the driving fluid 36 and the medium 32. "Pressure exchange" refers to the exchange of pressure between the two different fluids being pumped (driving fluid 36 and medium 32).

The driving fluid valve arrangement 14 is located at a positive displacement pump end 48 and comprises a driving fluid entry valve 50, a driving fluid exit valve 52, a compression valve 54, a decompression valve 56, a choke valve 57, and a master valve actuator 58. The master valve actuator 58 is provided to actuate the various valves 50 to 56 at the correct time for efficient operation of the pumping system 10.

As shown in FIG. 1A, the driving fluid entry valve 50 includes a hydraulic actuator 58*a* to open and close the fluid entry valve 50. Similarly, a hydraulic actuator 58*b,c,d* is paired with each of the driving fluid exit valve 52, the compression valve 54, and the decompression valve 56. Each of these hydraulic actuators 58*a,b,c,d* is controlled by the master valve actuator 58. This is not shown in FIG. 1A for clarity.

In this embodiment, the master valve actuator 58 comprises a hydraulic power unit. This power unit 58 is coupled to a plurality of individual valve actuators 58*a,b,c,d*, one in each valve 50,52,54,56. These actuators 58*a,b,c,d* are operable to control their respective valves 50,52,54,56, in response to the master valve actuator 58 receiving a command from the system controller 70.

In this embodiment, these valves are all high pressure (for example, greater than 40 Bar) actuated, non-return, poppet seated valves; however, in other embodiments, different types of valves may be used.

The choke valve 57 (one is illustrated in FIG. 1; whereas, two are illustrated in FIG. 1A) is installed in series with the compression 54 and decompression 56 valves to limit and control the flow rate during compression and decompression of the pressure exchange chamber 12. By limiting the flow rate of the driving fluid 36 (and any medium 32 that passes through these valves 54,56), wear in the compression 54 and decompression 56 valves is reduced.

In other embodiments, a separate, dedicated, choke valve may be provided for each of the compression 54 and decompression 56 valves (i.e. two choke valves may be used, as shown in FIG. 1A). The choke valves may comprise fixed geometry restrictions such as orifice plates and can be positioned up or downstream of the compression and decompression valve.

To allow the entry 50 and exit 52 valves to open in a generally pressure balanced environment, a pressure balancing line 60 is provided. This pressure balancing line 60 couples the compression valve 54 and the decompression valve 56 for the pressure exchange chamber 12 in a bypass arrangement (i.e. bypassing the driving fluid entry 50 and exit 52 valves).

The compression valve 54 is provided to bypass the driving fluid entry valve 50 so that the pressure in the pressure exchange chamber 12 can be raised prior to opening of the driving fluid entry valve 50; thereby reducing the force required to open the valve 50 and reducing the fluid flow rate through the driving fluid entry valve 50 upon opening. This has the advantage of prolonging the life of the driving fluid entry valve 50.

Similarly, the decompression valve 56 is provided to bypass the driving fluid exit valve 52 so that the pressure in the pressure exchange chamber 12 can be lowered prior to opening of the driving fluid exit valve 52; thereby preventing high flow rates of the driving fluid 36 through the driving fluid exit valve 52 upon opening thereof.

The compression 54 and decompression 56 valves are designed to open against a high pressure differential. However, these valves primarily allow flow of the driving fluid 36 (not the ore carrying medium 32 being pumped) and therefor operate on cleaner fluid (having fewer particles, or at least fewer large sized particles). This means that these valves are not subjected to undue wear.

The pumped medium valve arrangement 16 is located at delivery end 22 and comprises a pumped fluid exit valve 62 (also referred to as a discharge valve), a pumped fluid entry valve 64 (also referred to as a suction or filling valve), and a master valve actuator 66 to actuate the valves 62, 64 at the appropriate time. The pumped fluid entry 64 and exit 62 valves open in a pressure balanced situation when the pressure exchange chamber 12 is properly decompressed or compressed respectively.

As shown in FIG. 1A, the pumped fluid exit valve 62 includes a hydraulic actuator 66*a* to open and close the fluid exit valve 62. Similarly, a hydraulic actuator 66*b* is paired with the pumped fluid entry valve 64. Each of these hydraulic actuators 66*a,b* is controlled by the master valve actuator 66 (shown in broken line in FIG. 1A).

In this embodiment, the master valve actuator 66 is also a hydraulic power unit. This power unit 66 is coupled to two individual valve actuators 66*a,b*, one in each valve 62,64. These actuators 66*a,b* are operable to control their respective valves 62,64, in response to the master valve actuator 66 receiving a command from the system controller 70. The pumped fluid exit 62 and entry 64 valves are suitable for use with high pressures (e.g. greater than 40 Bar).

In this embodiment, the pumped fluid entry 64 and exit 62 valves are closed after closing the respective driving fluid entry 50 and exit 52 valves. In other words, the driving fluid entry valve 50 is closed before the pumped fluid exit valve 62; and the driving fluid exit valve 52 is closed before the pumped fluid entry valve 64. This has the advantage of stopping the flow of driving fluid 36 (and hence also the flow of the medium 32) before the pumped fluid entry and exit 50,52 valves are closed. This allows the larger particles in the medium 32 to settle away from the pumped fluid entry and exit valves 64,62, before closing the pumped fluid entry 64 and exit 62 valves; thereby lowering the risk of trapping large particles from the medium 32 in those valves 62,64.

As shown in FIG. 1A, the entry and exit valves 50,52, 62,64 are arranged such that the pressure differential across the valves 50,52,62,64 when closed assists in retaining the valves 50,52,62,64 in the closed position. For the pumped fluid entry and pumped fluid exit valves 64,62, the flow direction of the pumped fluid (the medium and the driving fluid) 36,32 assists in opening those valves 64,62. For the driving fluid entry and exit valves 50,52, the flow direction of the pumped fluid (the medium and the driving fluid) 36,32 works in the opposite way, assisting the valves 50,52 to close. This ensures proper sealing of the valves 50,52,54, 56,62,64 when closed, assisted by the pressure differential without additional actuator force. The valve 50,52,54,56,62, 64 will open in a near to pressure balanced condition when only a small force is applied by the actuator 58*a,b,c,d* and 66*a,b*. Small refers to small with respect to the hydraulic closing force across the valve 50,52,54,56,62,64 in the closed position with the full pressure differential between the high and low pressure parts of the system 10 being present across the valve 50,52,54,56,62,64.

Opening in a near to pressure balanced condition applies to the driving fluid entry and exit valves 50,52 and the pumped fluid entry and exit valves 64,62. Opening in a near to pressure balanced situation eliminates high flow velocities in the valve 50,52,54,56,62,64 upon opening which otherwise would occur due to the high pressure differential across the valve 50,52,54,56,62,64. These high flow velocities otherwise would damage the functional sealing surfaces of the valve 50,52,54,56,62,64 because of the small abrasive particles present in both the driving fluid 36 and the pumped medium 32.

The automatic opening in a near to pressure balanced situation allows the relatively small actuator force to be applied before pressure equalization is completed upon opening of the compression or decompression valve 54, 56. This significantly simplifies the system controller 70 as it does not require a pressure measurement to determine correct pressure equalization before actuating the driving fluid 36 and pumped medium 32 entry and exit valves 50,52,64,62.

The compression and decompression valves 54,56 are designed to be opened when the full pressure differential is still present, hence require a larger actuator force in relation to the hydraulic closing force present from the pressure differential across them. In order to limit the flow velocity in the functional sealing surfaces of the compression and decompression valves 54,56, one or more chokes 57 can be installed either up or downstream of the individual compression and decompression valves 54,56. In this embodiment, the choke 57 is a restriction in the bypass lines, such as an orifice plate. Hereby the choking function, with its higher allowance for wear, is separated from the sealing function of the compression and decompression valves 54,56 with their lower wear allowance, lowering their requirements for wear resistance. In other words, by using a restriction (choke 57) the wear experienced by the valves 54,56 is reduced. By separating the flow velocity control function from the sealing function, it is easier to design a wear resistant part to perform the velocity control function than designing high wear resistant sealing parts that must retain complementary formations.

In some embodiments the master valve actuators 58 and 66 can be combined in a single master valve actuator which controls all valve actuators 58*a,b,c,d* and 66*a,b* of all actuated valves 50,52,54,56,62,64.

The pumping system 10 also includes a system controller 70 for controlling the operation of the entire system, including the pumps 30,34, the valves 50 to 56 and 62 to 64, and the master valve actuators 58,66.

Each of the pumps 30, 34 needs to be provided with fluid. In this embodiment, a first (surface) fluid source 74 is provided at the surface 28 to provide water for the driving fluid 36. This provides water from the surface 28, which may be sea water or lake water for sea bed or lake bed applications, or water from a dewatering pump in underground (or open pit) mining applications. This provides the hydrostatic pressure benefit of using surface water. The fluid source 74 may include a filter for removing large particulates from the fluid prior to providing it to the positive displacement pump 34.

The fluid source 74 may be used to extract and reuse fluid from the pumped medium 32 in the collection receptacle 26 so that fluid from the medium 32 can be used as driving fluid 36, optionally, with additional fluid being provided by water sourced locally (in underground or open pit applications from dewatering equipment used for pumping unwanted water from the mine, or excess water if it is readily available; in sea or lake bed applications, from surface water). In sea or lake bed applications reuse of the tailings from the medium that was pumped to the surface has the advantage of removing the requirement to dispose of tailings (unwanted fluid or particles from the medium 32) at the surface. This is because the driving fluid 36 (which contains the tailings) that is displaced from the pressure exchange chamber 12 during the pressure exchange chamber filling step (step 106 in FIG. 2, and steps 402, 406, 410 in FIG. 5) can be discharged directly onto the sea or lake bed.

In this embodiment, a second fluid source 76 is provided at approximately the same level as the pressure exchange chamber 12 to provide water to mix with ore to create the medium 32. This uses local water, which may be sea water or lake water for sea bed or lake bed applications, or mine water in underground (or open pit) mining applications.

Figure 2A:
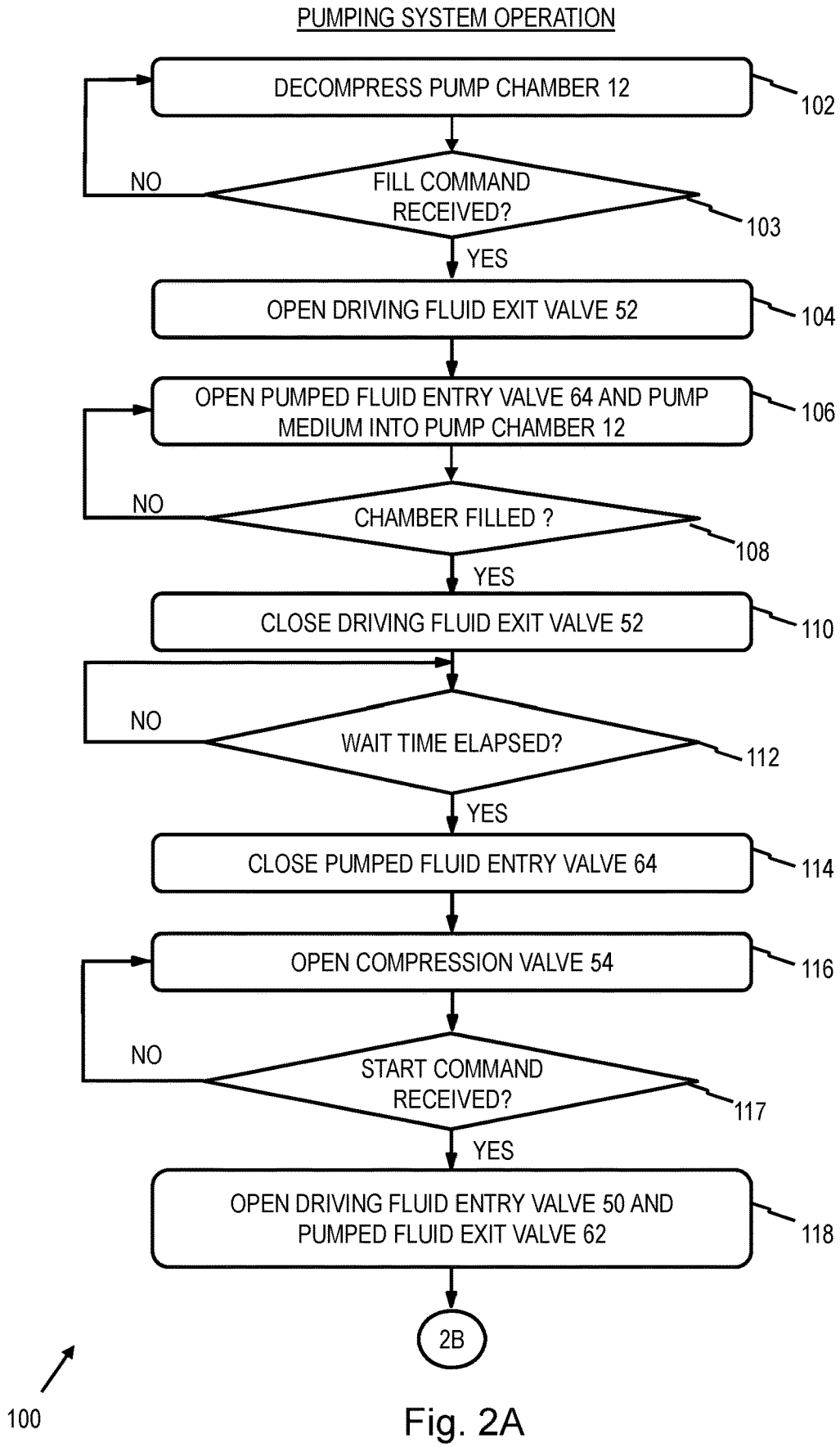
FIG. 2 is a flowchart (split over two drawing sheets) illustrating the steps involved in operating the pumping system of FIG. 1.
Figure 2B:
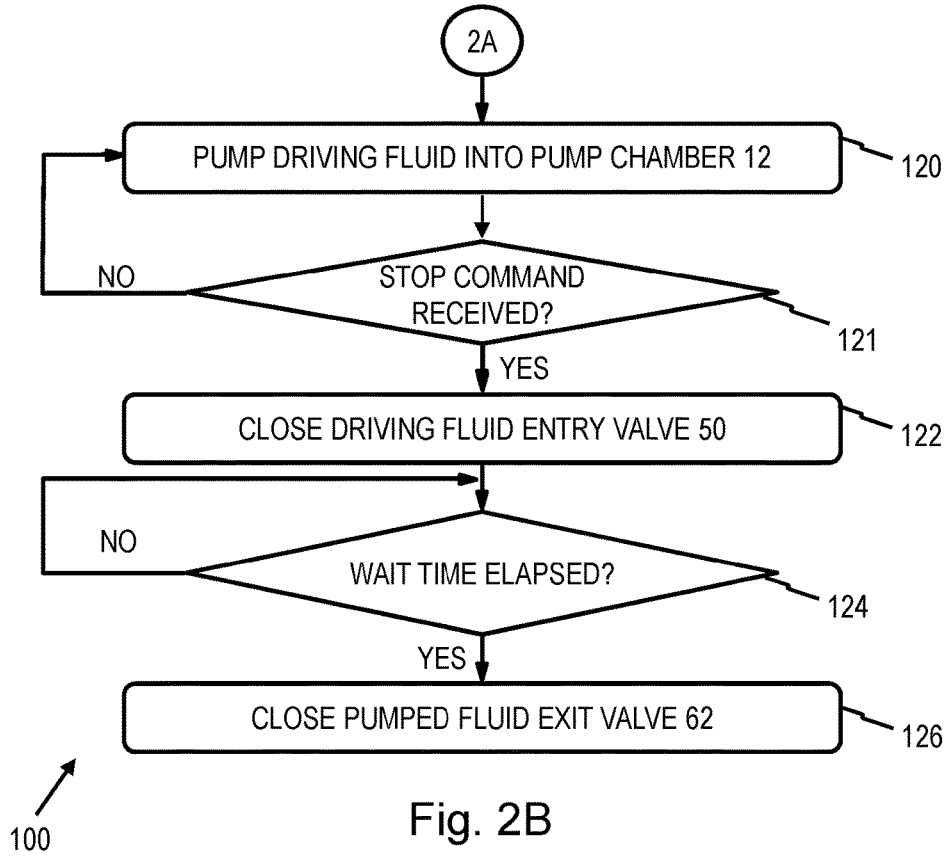

Reference is now also made to FIG. 2, which is a flowchart (100) illustrating steps performed during operation of the pumping system 10.

The first step illustrated (step 102) is the decompression step. In this step, the master valve actuator 58 opens the decompression valve 56 to decompress the pressure exchange chamber 12 to the pressure in the driving fluid outlet line 42, thereby allowing the driving fluid exit valve 52 and the pumped fluid entry valve 64 to be opened.

The decompression step continues until a fill command is received (step 103).

Once the fill command is received (which occurs once the pressure exchange chamber 12 is sufficiently decompressed), the master valve actuator 58 opens the driving fluid exit valve 52 (step 104). Master valve actuator 58 may energise the exit valve 52 during the decompression step (step 102). Due to the limited opening pressure of the valve 52, it will only open once the pressure differential has dropped to the opening pressure of the valve 52, as determined by the opening force of the master valve actuator 58. In this embodiment, it is preferred (but not essential) that the master valve actuator 58 closes the decompression valve 56 before driving fluid 36 is displaced out of the pressure exchange chamber 12 to prevent the medium 32 passing through the decompression valve 56.

Once the chamber is decompressed, the master valve actuator 66 then opens the pumped fluid entry valve 64 (suction valve) and once the pumped fluid entry valve 64 (suction valve) is open, the medium 32 automatically flows into the pressure exchange chamber 12 due to the operation of the centrifugal pump 30 (step 106). Master valve actuator 66 may energise the entry valve 64 during the decompression step (step 102). Due to the limited opening pressure the valve 64 will only open once the pressure differential has dropped to the opening pressure of the valve 64, as determined by the opening force of the master valve actuator 66. The medium entering the pressure exchange chamber 12 displaces the driving fluid 36 out of the pressure exchange chamber 12 through the driving fluid exit valve 52, so that the medium 32 starts to fill the pressure exchange chamber 12. The medium 32 is pumped at a relatively high flow rate but relatively low pressure so the pressure exchange chamber 12 fills relatively rapidly.

Once the pressure exchange chamber 12 is filled (which may be determined by a direct or indirect measurement or estimation of filled volume, for example by integration of the measured or estimated flow rate in time by the system controller 70) (step 108), the master valve actuator 58 closes the driving fluid exit valve 52 (step 110), thereby stopping the outflow of driving fluid 36 from the pressure exchange chamber 12 and stopping the inflow of medium 32 to the pressure exchange chamber 12.

After the flow of medium 32 has stopped, the master valve actuator 66 waits for a predetermined time (step 112). In this embodiment, the wait time is 3 seconds, but in other embodiments the wait time may be selected for a time between zero seconds and ten seconds. This wait time allows larger particles in the medium 32 to settle to a lower part of the pressure exchange chamber 12 and away from the valve seat of valve 64, thereby allowing a better closure of the valve 64.

The master valve actuator 66 closes the pumped fluid entry valve 64 (suction valve), after the predetermined wait time has elapsed (step 114).

Once the pumped fluid entry valve 64 (suction valve) is closed, the master valve actuator 58 opens the compression valve 54 (step 116), thereby allowing high pressure driving fluid 36, delivered by the positive displacement pump 34, to enter the pressure exchange chamber 12. This compresses the contents of the pressure exchange chamber 12 to the pressure in the driving fluid inlet line 40.

After compression of the pressure exchange chamber 12 has reached a sufficient level, and an empty (or start) command is received, (step 117), the master valve actuators 58, 66 open the driving fluid entry valve 50 and the pumped fluid exit valve 62 (step 118). As above, the master valve actuators 58,66 may actuate the valves 50,62 prior to pressure equalisation as the valves 50,62 will only open once the pressure differential has dropped to the opening pressure of the valves 50,62, as determined by the opening force of the master valve actuators 58,66. In this embodiment, it is preferred (but not essential) that the master valve actuator 58 closes the compression valve 54 when the pressure is equalised so that driving fluid 36 flows primarily through the driving fluid entry valve 50 rather than the compression valve 54.

Once these valves 50,62 are open, driving fluid 36 flows into the pressure exchange chamber 12 through the driving fluid inlet line 40 and the driving fluid entry valve 50 due to the operation of the positive displacement pump 34 (step 120). The driving fluid 36 displaces the medium 32 through the pumped fluid exit valve 62, the medium outlet line 29, the pressurised discharge 20, and partly up the pumped medium riser 24 (depending on the height of the riser 24).

Once the medium 32 is displaced into the medium outlet line 29 (which may be determined by a direct or indirect measurement or estimation of filled volume, for example by integration of the measured or estimated flow rate in time by the system controller 70) (implemented by a stop command being generated by the system controller 70, step 121), the driving fluid entry valve 50 is closed (step 122). This stops the inflow of driving fluid 36 into the pressure exchange chamber 12, and stops the outflow of medium 32 from the pressure exchange chamber 12.

After the outflow of medium 32 has stopped, the master valve actuator 66 waits for a predetermined time (step 124). In this embodiment, the wait time is 3 seconds, but in other embodiments the wait time may be selected for a time between zero seconds and ten seconds. This wait time allows larger particles in the medium 32 to settle to a lower part of the pressure exchange chamber 12 and away from the valve seat of the pumped fluid exit valve 62, thereby allowing a better closure of the valve 62.

In other embodiments, as an addition, or alternative, step 120 is extended so that the driving fluid 36 flows through the pumped fluid exit valve 62. This ensures that the pumped fluid exit valve 62 closes in the presence of the driving fluid 36, which may be cleaner, or may have fewer large particles, than the medium 36. In such embodiments, the pumped fluid (or medium) 32 may include some driving fluid 36. This also prevents the build-up of particles from the medium in the pressure exchange chamber 12.

The master valve actuator 66 closes the pumped fluid exit valve 62 (discharge valve), after the predetermined wait time has elapsed (step 126).

Once the pumped fluid exit valve 62 is closed, the sequence goes back to step 102 for decompression of the pressure exchange chamber 12 and starting a new medium fill process.

Figure 3:
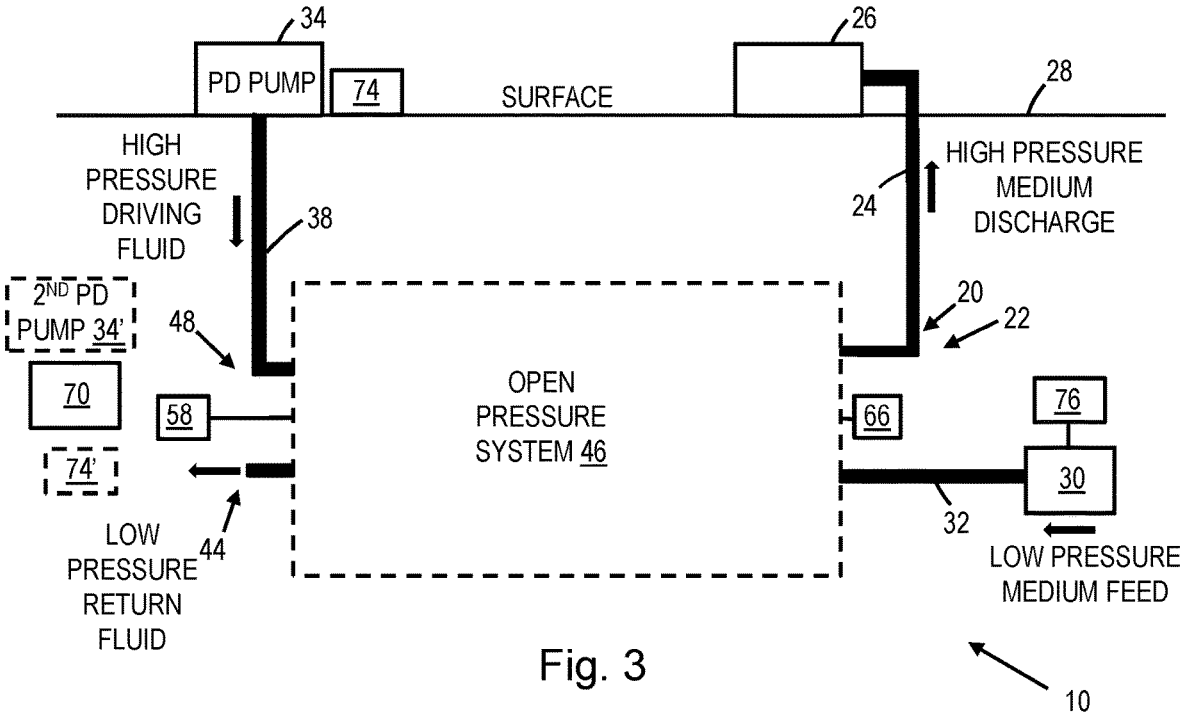
FIG. 3 is a simplified schematic diagram of the pumping system of FIG. 1 illustrating a part of FIG. 1 (the open pressure exchange system) in a generalised manner.

Reference is now made to FIG. 3, which is a simplified schematic diagram of the pumping system 10 of FIG. 1. In FIG. 3, the open pressure exchange system 46 (that is, the pressure exchange chamber 12, the driving fluid valve arrangement 14, the pumped medium valve arrangement 16, the driving fluid inlet and outlet lines 40,42, and the medium inlet and outlet lines 31,29) is indicated generally by numeral 46.

Figure 4:
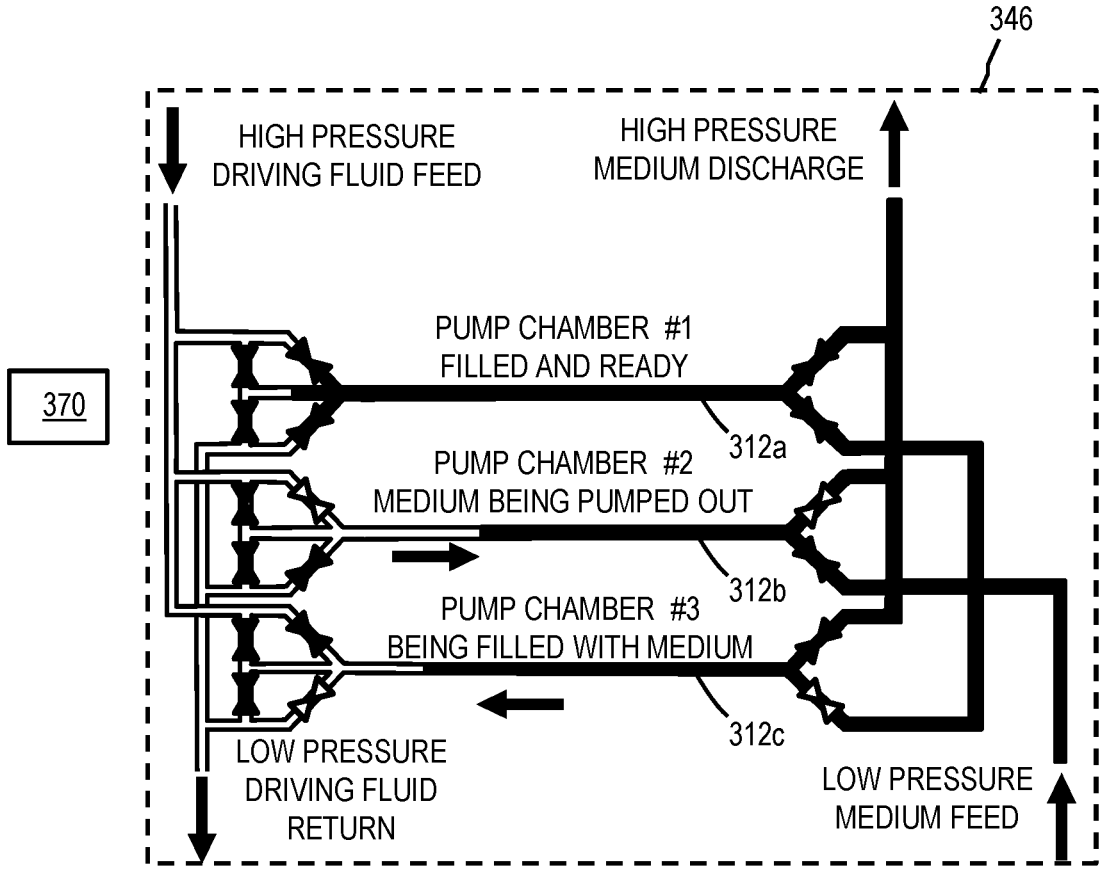
FIG. 4 is a simplified schematic diagram of another pumping system according to a second embodiment of the present invention, where the second embodiment includes three pressure exchange chambers (in an alternative open pressure exchange system to that of FIG. 1) and an upgraded controller.

Reference is now made to FIG. 4, which is a simplified schematic diagram of another pumping system 310, according to a second embodiment of the present invention. For clarity, those parts that are common with the parts of the FIG. 1 embodiment have been removed. This pumping system 310 is very similar to pumping system 10. The main differences are that the open pressure exchange system 346 comprises three pressure exchange chambers 312*a,b,c* instead of one pressure exchange chamber 12, and the system controller 370 manages the sequential filling and discharge of the three pressure exchange chambers 312.

Each of the three pressure exchange chambers 312*a,b,c* includes identical valves to those described with reference to the pumping system 10 of FIG. 1 (choke valve 57 is not illustrated in FIG. 4 for clarity, but it is included in each pressure exchange chamber 312). Each of the three pressure exchange chambers 312*a,b,c*, is identical (or at least very similar for all practical purposes) to the pressure exchange chamber 12 of FIG. 1. Pump system 310 also includes a pump system controller 370 that is similar to pump system controller 70 but additionally manages the sequential filling and discharge of the three pressure exchange chambers 312. The sequencing of pressure exchange chamber 312*a,b,c* filling and discharge may be governed primarily by timing settings in the pump system controller 370, or may be influenced by the status (or a condition) of another pressure exchange chamber 312*a,b,c*.

By having multiple pressure exchange chambers 312 arranged in parallel, the pumping system 310 can ensure that at least one pressure exchange chamber 312 is always filled with medium 32 and ready for discharge, thereby allowing a continuous feed of driving fluid 36 to the pressure exchange chambers 312 and a continuous feed of medium 32 to the pressure exchange chambers 312.

Figure 5:
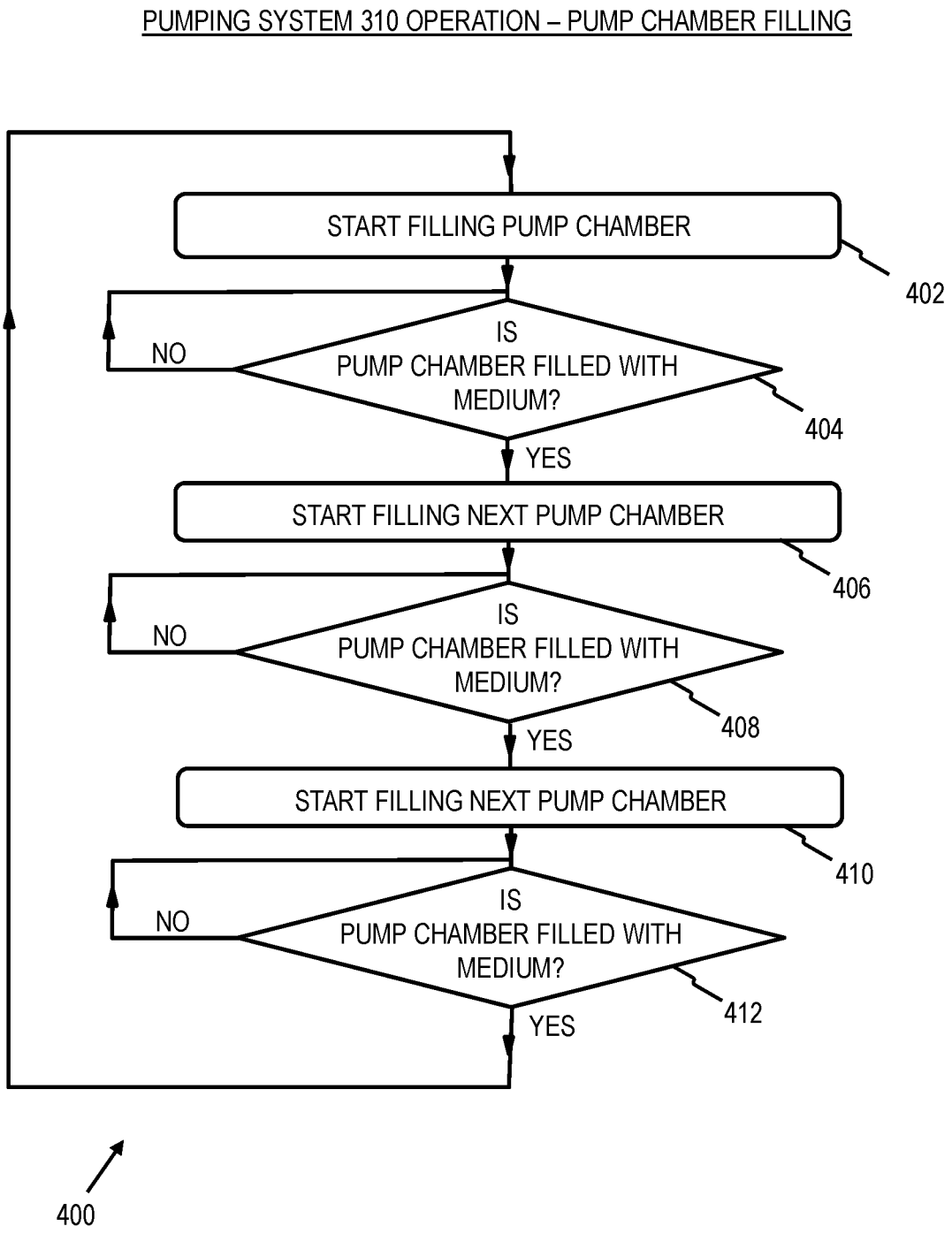
FIG. 5 is a flowchart illustrating the steps involved in operating the pumping system of FIG. 4 during a filling (or back-fill) operation.
Figure 6:
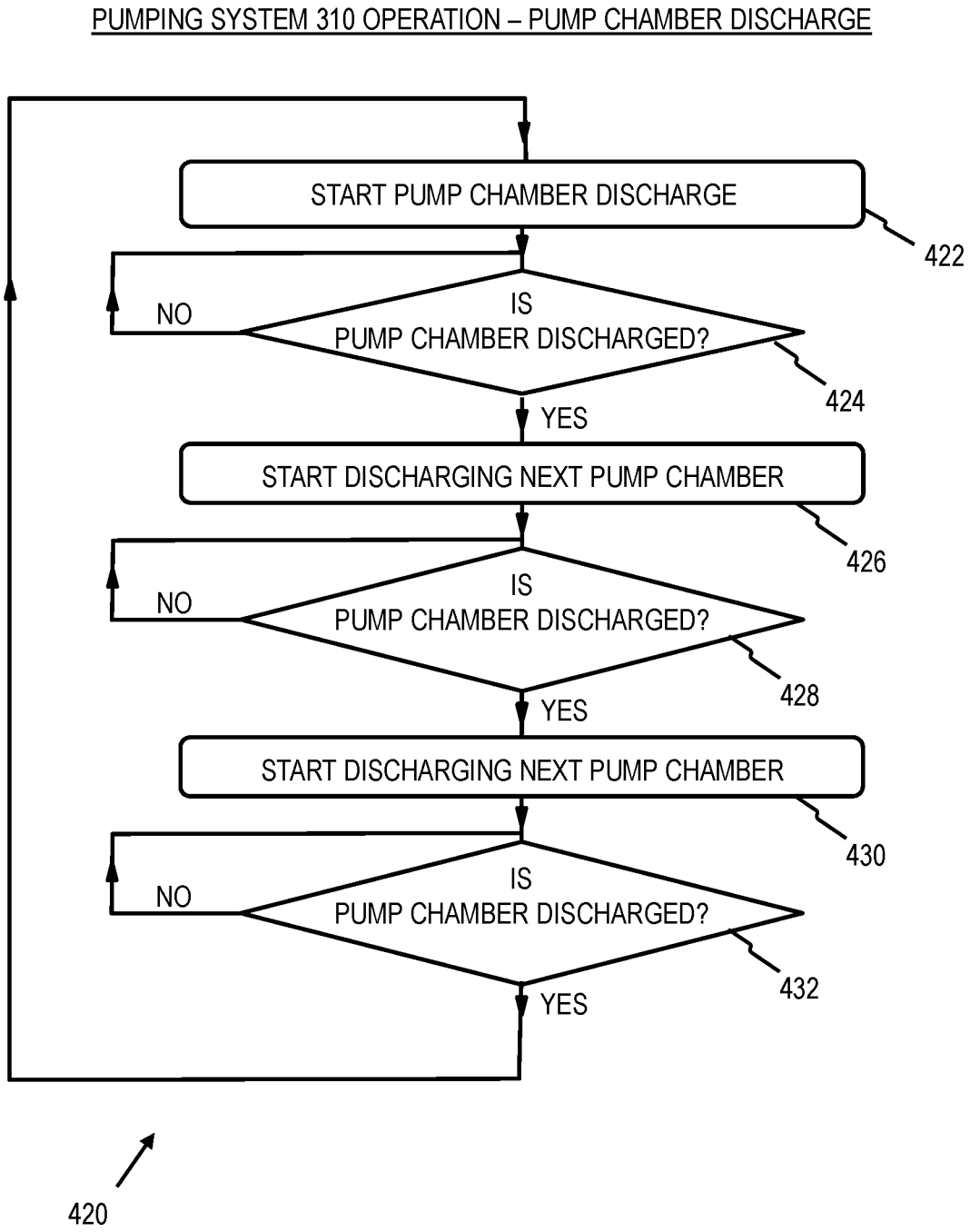
FIG. 6 is a flowchart illustrating the steps involved in operating the pumping system of FIG. 4 during a discharge operation.

Reference is now made to FIGS. 5 and 6, which are flowcharts 400, 420 illustrating steps performed during operation of the pumping system 310 (filling and discharge, respectively).

Initially, one of the pressure exchange chambers (e.g. the first pressure exchange chamber 312*a*) is filled using step 106 of the process 100 of FIG. 2 (step 402).

The system controller 370 then allows the first pressure exchange chamber 312*a* to fill until step 108 (FIG. 2) is reached (step 404).

Once the first chamber 312*a* has reached step 108 (FIG. 2), then the system controller 370 starts filling the next pressure exchange chamber 312*b* (step 406).

The system controller 370 then allows the second pressure exchange chamber 312*b* to fill until step 108 (FIG. 2) is reached (step 408).

Once the second chamber 312*b* has reached step 108 (FIG. 2), then the system controller 370 starts filling the next pressure exchange chamber 312*c* (step 410).

The system controller 370 then allows the third pressure exchange chamber 312*c* to fill until step 108 (FIG. 2) is reached (step 412).

The process then reverts to filling the first pressure exchange chamber 312*a* (step 402).

With reference to FIG. 6, initially, the system controller 370 starts discharging the first pressure exchange chamber 312*a* using step 120 of the process 100 of FIG. 2 (step 422).

The system controller 370 then allows the first pressure exchange chamber 312*a* to discharge until step 122 (FIG. 2) is reached (step 424).

Once the first chamber 312*a* has reached step 122 (FIG. 2), then the system controller 370 starts discharging the next pressure exchange chamber 312*b* (step 426).

The system controller 370 then allows the second pressure exchange chamber 312*b* to discharge until step 122 (FIG. 2) is reached (step 428).

Once the second chamber 312*b* has reached step 122 (FIG. 2), then the system controller 370 starts discharging the next pressure exchange chamber 312*c* (step 430).

The system controller 370 then allows the third pressure exchange chamber 312*c* to discharge until step 122 (FIG. 2) is reached (step 432).

The process then reverts to discharging the first pressure exchange chamber 312*a* (step 422).

This sequence of filling and discharging provides a gradual take-over of the filling flow from one pressure exchange chamber 312 to the next, and of the discharge flow from one pressure exchange chamber 312 to the next.

To maintain an uninterrupted feed into and out of the pumping system 310 the timing of the sequence of the individual pressure exchange chambers 312 is controlled and aligned by the system controller 370.

Multiple parameters can be used to control the timing of the sequence. For example, the flow rate of the driving fluid 36 can be adjusted. The flow rate of the driving fluid 36 is directly proportional to the pump speed of the positive displacement pump 34. The duration of the pressure exchange chamber discharge step (step 120) can be adjusted. In preferred embodiments, the chamber discharge step (step 120) continues after displacing the medium 32 out of the pressure exchange chamber 312 allowing the pumped fluid exit (discharge) valve 62 to close through the less contaminated driving fluid 36 rather than in the pumped medium 32.

The flow rate of the filling mechanism (centrifugal pump in the above embodiments) 30 can be adjusted. The flow rate of such a pump can be changed by changing either the speed of the pump 30 itself, or by changing the pressure load on the pump 30 by using a flow control valve in the driving fluid outlet line 42. As the flow rate of a centrifugal pump is dependent on both the speed of the pump as well as the pressure load of the pump a flow rate measurement in the driving fluid outlet line 42 may be used to ascertain the actual flow rate.

The duration of the chamber fill step (step 106) can be adjusted. In preferred embodiments, the chamber fill step (step 106) stops before displacing the medium 32 out of the pressure exchange chamber 312 through the driving fluid exit valve 52, allowing the driving fluid exit valve 52 to close in the less contaminated driving fluid 36 rather than in the pumped medium 32.

One advantage of the pumping system 10, 310 with a direct contact between the driving fluid 36 and the pumped medium 32 is that the duration of the fill and discharge steps can be extended almost without limit. This is in contrast to the fixed end stops on the stroke in a crankshaft or hydraulic driven pump, or the pressure exchange systems using a separating element between the driving fluid and the pumped mixture. This allows great flexibility in the timing of the sequence making it very robust even if there are timing variations due to varying conditions in the pump 34.

As an alternative to the embodiments of FIGS. 1 to 6, it is possible to locate the first fluid source 74 at the same level as the pressure exchange chamber(s) 12, 312. This is illustrated as low level fluid source 74' in broken line in FIG. 1. The low level fluid source 74' can reuse the driving fluid 36 expelled by the pressure exchange chamber(s) 12, 312 during the pressure exchange chamber filling step (step 106 in FIG. 2, and steps 402, 406, 410 in FIG. 5) by feeding it into the driving fluid inlet line 40, either partially (with some driving fluid provided from elsewhere) or fully (with all driving fluid provided from the fluid source 74'). However, this expelled fluid is at a much lower altitude than the location of the surface positive displacement pump 34, and the driving fluid inlet line 40 is at a high pressure (fed by the positive displacement pump 34), so it would require the low level fluid source 74' to be driven by a second positive displacement pump 34' located at the level of the pressure exchange chamber 12 (shown in broken line FIG. 1). The second positive displacement pump 34' may be used to deliver all of the driving fluid, negating the requirement for a surface positive displacement pump 34 (as shown in FIG.

7). This has advantages in underground mine locations where there is water available at the underground level for creating the slurry mix, and excess water from the pumped medium can be removed and disposed of at the surface. This would lower the mine dewatering requirements that most underground mines already have.

Figure 8:
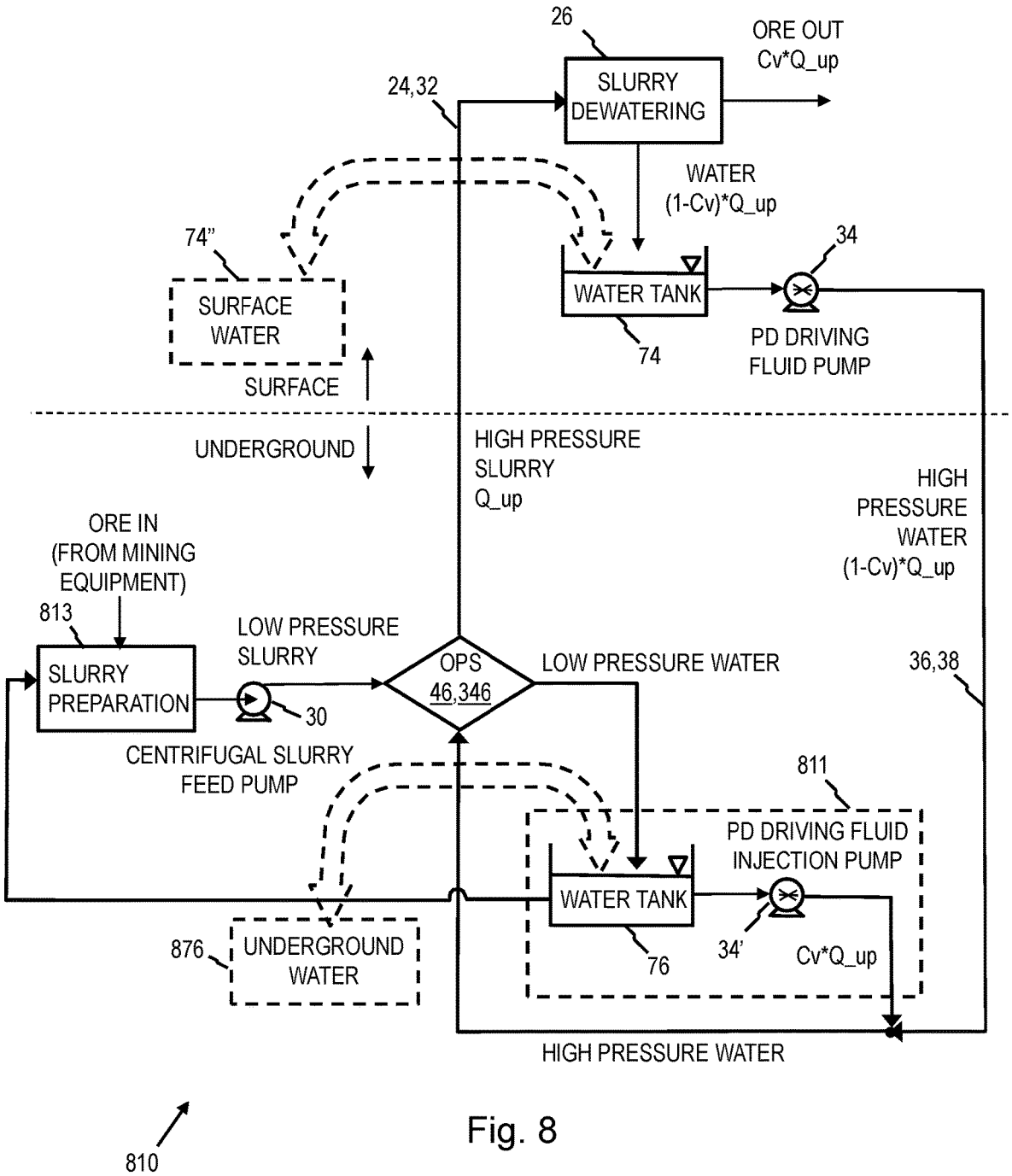
FIG. 8 is a simplified schematic diagram illustrating a general configuration of a pumping system 810 for an underground system, with variants shown in broken line, using an underground positive displacement driving fluid injection pump in a closed circuit, according to an embodiment of the present invention.

It is possible to combine the surface fluid source 74 configured to extract and reuse fluid from the pumped medium 32 so that fluid from the medium 32 can be used as driving fluid 36, with the second positive displacement pump 34' configured to reuse the driving fluid 36 discharged during the pump filling chamber step (step 106 in FIG. 2, and steps 402, 406, 410 in FIG. 5) so that a theoretically closed loop fluid system is provided that does not require any (or only very little) external fluid input once it is operational because all driving fluid 36 and medium 32 fluid is re-used (shown by solid lines in FIG. 8). In this example, the second positive displacement pump 34' compensates for the shortage of driving fluid 36 coming from the dewatering of the medium 32 at the surface 28. The use of positive displacement driving fluid pumps 34, 34' allows this parallel driving fluid pump installation which would be much more difficult to do with parallel centrifugal driving fluid pumps as the pressure sensitivity of the flow rate would result in interaction between the individual centrifugal pumps.

Figure 7:
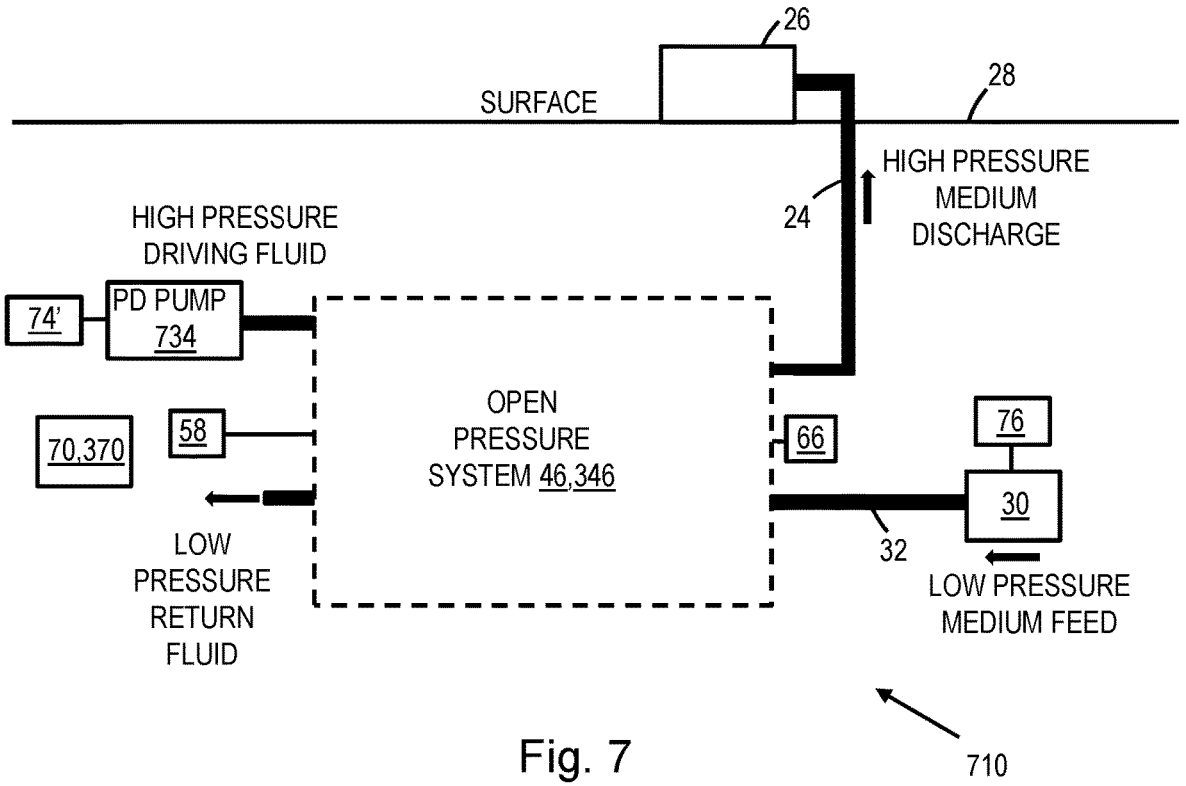
FIG. 7 is a simplified schematic diagram illustrating a third embodiment of a pumping system having an alternative location for part (the positive displacement pump) of the pumping system of either FIG. 1 or FIG. 4.

Reference will now be made to FIG. 7, which is a simplified schematic diagram illustrating a third embodiment of a pumping system 710 having an alternative location for part (the positive displacement pump) of the pumping system of FIG. 1 or FIG. 4.

In the first and second embodiments (FIGS. 1 to 6), the positive displacement pump 34 is located at the surface 28, significantly higher than the pressure exchange chamber(s) 12, 312. For example, the surface 28 may be from 50 m to 5000 m higher in altitude than the pressure exchange chamber 12. However, it is possible to locate the positive displacement pump at approximately the same level (or altitude or depth) as the pressure exchange chamber 12 or chambers 312. This is illustrated as low level positive displacement pump 734 in FIG. 7.

This has the advantage that the positive displacement pump 734 is located near to the pressure exchange chamber (s) 12, 312 thereby improving load response time when switching between pressure exchange chambers 312. Another advantage is that a driving fluid riser (riser 38 in FIG. 1) is not required as the driving fluid 36 can be provided by the low level fluid source 74'. Alternatively, a driving fluid riser may be used to provide the driving fluid 36 from the surface 28 directly to positive displacement pump 734. This has the advantage that the hydrostatic pressure in the driving fluid riser creates a high suction pressure on the positive displacement pump 734 reducing its energy consumption.

Where the pressure exchange chamber(s) 12, 312 are located underground (as opposed to on a sea or lake bed), the positive displacement pump 734 has to deliver the full power to overcome the pressurised discharge 20 (i.e. to lift the medium 32 to the surface 28). Where the pressure exchange chamber(s) 12, 312 are located on a sea (or lake) bed, the surrounding water can be used as the driving fluid 36, and this has hydrostatic pressure based on the depth of the water, so the positive displacement pump 734 only has to overcome the pressure difference due to the density difference of the sea water and the medium 32 in the pumped medium riser 24, plus the frictional losses in the pumped medium riser 24.

Alternatively, in a similar way as described with reference to FIG. 1, the driving fluid 36 may be supplied from a surface fluid source 74 via a driving fluid riser 38.

Providing the positive displacement pump 34 at the same level as the pressure exchange chambers 312 has the disadvantage that it may be expensive to provide a high energy power source where the pressure exchange chambers 312 are located (e.g. down a mine or on a sea bed).

It will now be appreciated that the positive displacement pump 34 may be located at the surface 28 or at a negative altitude. Similarly, the driving fluid 36 may be provided from the surface 28 or from the negative altitude, or a combination of the two.

Reference will now be made to FIG. 8, which is a simplified schematic diagram illustrating a general configuration of a pumping system 810, with variants shown in broken line, for an underground system using an underground positive displacement driving fluid injection pump in a closed circuit, according to an embodiment of the present invention. The pumping system 810 includes the open pressure exchange system 46,346 as described above.

In FIG. 8, $C_v$ refers to the volumetric concentration of solids in a slurry and Q_up refers to the total flowrate that the pumping system 810 delivers. The surface fluid source 74 is illustrated as a water tank at atmospheric pressure. This (first) surface fluid source 74 may be fed by any readily available water (illustrated by box 74") from the surface of a sea, lake, or pond, or from dewatering equipment when required depending on which system variant is used.

A broken line box 811 is shown around the second positive displacement pump 34' (or in some embodiments, the only positive displacement pump 34') and the second fluid source 76. In underground (not sea or lake bed) environments, the second fluid source 76 is required to capture fluid from the open pressure exchange system 46,346, otherwise the discharged driving fluid would flood the area. In such applications, the second fluid source 76 can feed a slurry preparation mixer 813 that mixes fluid from the second fluid source 76 with ore that has been mined (not shown). The embodiments of FIGS. 1, 3, and 7 also include a slurry preparation mixer 813, but it is not shown on those figures for clarity. In sea or lake bed environments, the second fluid source 76 is not required, because there is no need to capture fluid from the open pressure exchange system 46,34, because it can be discharged to the sea or lake water around the pressure exchange chamber 12,312.

FIG. 8 also shows an underground fluid source 876 (which may be a pond or tanks used for holding water) that can be used for supplying any fluid shortage, or receiving any excess fluid when required depending on which system variant is used.

The steps of the methods described herein may be carried out in any suitable order, or simultaneously where appropriate.

The terms "comprising", "including", "incorporating", and "having" are used herein to recite an open-ended list of one or more elements or steps, not a closed list. When such terms are used, those elements or steps recited in the list are not exclusive of other elements or steps that may be added to the list.

Unless otherwise indicated by the context, the terms "a" and "an" are used herein to denote at least one of the elements, integers, steps, features, operations, or components mentioned thereafter, but do not exclude additional elements, integers, steps, features, operations, or components.

The presence of broadening words and phrases such as "one or more," "at least," "but not limited to" or other similar phrases in some instances does not mean, and should not be construed as meaning, that the narrower case is intended or in instances where such broadening phrases are not used.

In other embodiments, the filling mechanism 30 may comprise a dredge pump, or any other convenient pump.

The reference numerals and corresponding parts that are used herein are provided below:

10 pumping system
12 pressure exchange chamber
14 driving fluid valve arrangement
16 pumped medium valve arrangement
20 pressurized discharge
22 delivery end
24 pumped medium riser
26 collection receptacle
28 surface
29 medium outlet line
30 filling mechanism
31 medium inlet line
32 medium (slurry pumped)
34 positive displacement pump
34' second positive displacement pump
36 driving fluid
38 driving fluid riser
40 driving fluid inlet line
42 driving fluid outlet line
44 driving fluid discharge point
46 open pressure exchange system
48 positive displacement pump end
50 driving fluid entry valve
52 driving fluid exit valve
54 compression valve
56 decompression valve
57 choke valve
58 master valve actuator (for valves 50 to 56)
60 pressure balancing line
62 pumped fluid exit valve
64 pumped fluid entry valve
66 master valve actuator (for valves 60, 62)
70 system controller
72 second positive displacement pump
74 surface fluid source
74' low level fluid source
76 second fluid source
100 flowchart
310 alternative pumping system
312*a,b,c* pressure exchange chambers
346 open pressure exchange system (3 chambers)
370 system controller
400 flowchart for filling the pressure exchange chamber 310
420 flowchart for discharging the pressure exchange chamber 310
710 pumping system
734 low level positive displacement pump
810 pumping system
811 box with optional components
813 slurry preparation mixer
876 underground fluid source

The invention claimed is:

1. A pumping system for pumping a medium comprising a liquid with ore particles from an underground or subsea location to a surface at a raised level, the system comprising:

at least one pressure exchange chamber, located at a lower altitude than the raised level, and comprising an elongate pipe which extends in a transverse orientation, and having a driving fluid valve arrangement at one end, and a pumped medium valve arrangement at an opposite end;

a pressurised discharge at a delivery end of the system on the pumped medium valve arrangement side of the pressure exchange chamber;

a riser extending upwardly from the delivery end to the raised level and for delivering the medium thereto;

a fluid source at approximately the same level as the pressure exchange chamber to provide water to mix with ore to create the medium;

a filling mechanism operable to fill the pressure exchange chamber with the medium; and a positive displacement pump connected to the pressure exchange chamber and operable to pump a driving fluid in direct contact with the medium without using a separating element so that the medium is displaced from the pressure exchange chamber to the pressurised discharge by the driving fluid.

2. The pumping system according to claim 1, wherein the driving fluid valve arrangement is located at the end of the pressure exchange chamber connected to the positive displacement pump and comprises a driving fluid entry valve, and a driving fluid exit valve and the pumped medium valve arrangement comprises a pumped fluid entry valve whereby medium can be fed into the pressure exchange chamber and a pumped fluid exit valve whereby medium can be discharged from the pressure exchange chamber, and an actuator associated with each valve and being configured to displace the valve between an open position and a closed position, the valves being configured such that the flow of pumped fluid assists in closing the driving fluid entry and driving fluid exit valves and assists in opening the pumped fluid entry and exit valves.

3. The pumping system according to claim 2, wherein the driving fluid valve arrangement further comprises a compression valve to bypass the driving fluid entry valve so that the pressure in the pressure exchange chamber can be raised prior to opening of the driving fluid entry valve and a decompression valve to bypass the driving fluid exit valve so that the pressure in the pressure exchange chamber can be lowered prior to opening of the driving fluid exit valve and a choke valve connected in series with the compression valve to limit the flow rate of driving fluid through the compression valve.

4. The pumping system according to claim 3, wherein the pumping system comprises a plurality of pressure exchange chambers connected in parallel and filled sequentially with the medium to be pumped and emptied sequentially with driving fluid.

5. The pumping system according to claim 4, wherein the pumping system further comprises a pressure exchange chamber controller operable to actuate the compression and decompression valves, the driving fluid entry and exit valves and when required the pumped fluid entry and exit valves, at the appropriate times to ensure that at least one pressure exchange chamber is full of medium when medium is discharged from a pressure exchange chamber while another pressure exchange chamber is being filled with medium.

6. The pumping system according to claim 1, wherein the positive displacement pump pumps the driving fluid in the same direction as the medium is flowing.

7. The pumping system according to claim 1, wherein the filling mechanism comprises a centrifugal pump.

8. The pumping system according to claim 1, wherein the positive displacement pump is located at approximately the same altitude as the pressure exchange chamber.

9. The pumping system according to claim 1, wherein the positive displacement pump is located at a higher altitude than the pressure exchange chamber.

10. The pumping system according to claim 1, wherein the system further comprises a driving fluid source located at approximately the same altitude as the pressure exchange chamber, wherein the driving fluid source reuses driving fluid expelled from the pressure exchange chamber during a filling step of the chamber.

11. The pumping system according to claim 10, further comprising a second positive displacement pump located at the level of the pressure exchange chamber.

12. The pumping system according to claim 1, wherein the pressurised discharge comprises either a feed to a pressurised container, or a feed into an elongate transportation line requiring a high pressure.

13. The pumping system according to claim 1, wherein the driving fluid and pumped medium valve arrangements comprise actuated, poppet, non-return valves that are oriented and configured so that: (i) a pressure differential across each valve acts on a high pressure side of the valve to assist in maintaining the valve in a closed position when the valves are not actuated, (ii) the flow direction of the driving fluid assists in closing the driving fluid valves, and (iii) the flow direction of the medium and driving fluid assists in opening the pumped medium valves.

14. The pumping system according to claim 13, wherein an actuator force is selected so that the valves only open in the presence of a small pressure differential even when actuated.

15. A method of pumping a medium comprising a liquid with ore particles from an underground or subsea location to a surface at a raised level using a system according to claim 1, the method comprising:

(i) de-pressurising a pressure exchange chamber that extends in a transverse orientation and is located an altitude that is lower than a raised level;

(ii) filling the pressure exchange chamber with the medium to be pumped using a relatively low pressure source;

(iii) pressurising the pressure exchange chamber using a positive displacement pump;

(iv) driving out the medium using a driving fluid in direct contact with the medium without using a separating element, where the driving fluid is delivered using the positive displacement pump; and (v) delaying closing pumped fluid entry and exit valves relative to driving fluid entry and exit valves to stop the flow of the medium before the pumped fluid entry and exit valves are closed, thereby allowing larger ore particles in the medium to settle away from the pumped fluid entry and exit valves before they are closed.

16. The method of pumping the medium according to claim 15 wherein step (ii) further comprises filling a pressure exchange chamber such that the medium passes through the pressure exchange chamber and out via a driving fluid exit valve.

17. The method of pumping the medium according to claim 15, wherein step (iv) further comprises driving out the medium using a driving fluid in direct contact with the medium such that the driving fluid passes through the pressure exchange chamber and out via the pumped fluid exit valve.

18. The method of pumping a medium according to claim 15, wherein the method comprises performing steps (i) to (iii) on a first pressure exchange chamber, then performing steps (i) to (iii) on a second pressure exchange chamber, before or while performing step (iv) on the first pressure exchange chamber.

19. The pumping system according to claim 1, wherein the system further comprises a driving fluid riser coupled to the positive displacement pump at the surface, and a driving fluid source located at the surface and operable to extract and reuse fluid from the medium received at the raised level so that fluid from the medium can be used as driving fluid.

20. The pumping system according to claim 19, wherein the system further comprises a fluid recovery filter for removing large particulates from fluid extracted from the medium prior to providing it to the positive displacement pump.

21. A pumping system according to claim 11, wherein the system further comprises a driving fluid riser coupled to the positive displacement pump at the surface, and a driving fluid source located at the surface and operable to extract and reuse fluid from the medium received at the raised level so that extracted fluid from the medium can be used as driving fluid, and with the second positive displacement pump configured to reuse the driving fluid discharged from the driving fluid exit valve whereby a closed loop fluid system is provided that requires very little, if any, external fluid input once it is operational because all driving fluid and fluid extracted from the medium is re-used.

22. A pumping system for pumping a medium comprising a liquid with ore particles from an underground or subsea location to a surface at a raised level, the system comprising:

at least one pressure exchange chamber, located at a lower altitude than the raised level, and comprising an elongate pipe which extends in a transverse orientation, and having a driving fluid valve arrangement at one end, and a pumped medium valve arrangement at an opposite end;

a pressurised discharge at a delivery end of the system on the pumped medium valve arrangement side of the pressure exchange chamber;

a riser extending upwardly from the delivery end to the raised level and for delivering the medium thereto;

a fluid source at approximately the same level as the pressure exchange chamber to provide water to mix with ore to create the medium;

a filling mechanism operable to fill the pressure exchange chamber with the medium; and a positive displacement pump connected to the pressure exchange chamber and operable to pump a driving fluid in direct contact with the medium so that the medium is displaced from the pressure exchange chamber to the pressurised discharge by the driving fluid, wherein the driving fluid valve arrangement is located at the end of the pressure exchange chamber connected to the positive displacement pump and comprises a driving fluid entry valve, and a driving fluid exit valve and the pumped medium valve arrangement comprises a pumped fluid entry valve whereby the medium can be fed into the pressure exchange chamber and a pumped fluid exit valve whereby the medium can be discharged from the pressure exchange chamber, and an actuator associated with each valve and being configured to displace the valve between an open position and a closed position, the valves being configured such that the flow of the medium and the driving fluid assists in closing the driving fluid entry and driving fluid exit valves and assists in opening the pumped fluid entry and exit valves.

* * * * *